US008820333B2

(12) United States Patent
Cristophe et al.

(10) Patent No.: US 8,820,333 B2
(45) Date of Patent: Sep. 2, 2014

(54) DEVICE AND METHOD FOR MIXING HAIR COLORING CHEMICALS

(76) Inventors: Schatteman Cristophe, Beverly Hills, CA (US); Sybrowsky Joshua, Lincoln, CA (US); Jean Roorcyk, Beverly Hills, CA (US)

( * ) Notice: Subject to any disclaimer, the term of this patent is extended or adjusted under 35 U.S.C. 154(b) by 93 days.

(21) Appl. No.: 13/816,478

(22) PCT Filed: Jan. 15, 2011

(86) PCT No.: PCT/US2011/021439

§ 371 (c)(1),
(2), (4) Date: Aug. 23, 2013

(87) PCT Pub. No.: WO2011/088427

PCT Pub. Date: Jul. 21, 2011

(65) Prior Publication Data

US 2013/0327351 A1 Dec. 12, 2013

(30) Foreign Application Priority Data

Apr. 13, 2010 (WO) ..... PCT/US2010/030929

(51) Int. Cl.

| | |
|---|---|
| ***A45D 2/00*** | (2006.01) |
| ***A45D 40/26*** | (2006.01) |
| ***A45D 19/02*** | (2006.01) |
| ***A45D 19/00*** | (2006.01) |
| ***A45D 40/24*** | (2006.01) |

(52) U.S. Cl.

CPC ..... *A45D 19/0008* (2013.01); *A45D 40/265* (2013.01); *A45D 19/02* (2013.01); *A45D 40/24* (2013.01)

USPC ..... 132/320; 132/221

(58) Field of Classification Search

USPC ..... 132/208, 108–116, 206, 320; 401/40–42, 134; 206/219, 222

See application file for complete search history.

(56) References Cited

U.S. PATENT DOCUMENTS

| | | | |
|---|---|---|---|
| 2,833,280 | A | 5/1958 | Hein |
| 2,954,144 | A | 9/1960 | Elam |
| 3,482,920 | A | 12/1969 | Schwartzman |
| 3,786,820 | A | 1/1974 | Kopfer |
| 4,750,615 | A | 6/1988 | Käufeler |
| 5,273,190 | A | 12/1993 | Lund |
| 5,277,303 | A | 1/1994 | Goyet |
| 5,337,764 | A | 8/1994 | McKay |
| 5,533,537 | A | 7/1996 | Mourad |
| 5,778,902 | A | 7/1998 | Nagy |
| 6,387,074 | B1 | 5/2002 | Horppu et al. |
| 6,660,047 | B1 | 12/2003 | Stanley, III |
| 6,976,494 | B2 | 12/2005 | Wayne |
| 7,252,091 | B1 | 8/2007 | Wayne |

(Continued)

*Primary Examiner* — Rachel Steitz

(74) *Attorney, Agent, or Firm* — Trojan Law Offices

(57) ABSTRACT

A device and method for mixing and applying hair coloring chemicals to a user's hair. The device comprises a brush applicator, a first compartment capable of holding the brush applicator, a second compartment containing a first hair coloring chemical, a third compartment containing a second hair coloring chemical, and a membrane. The brush applicator is movable toward the membrane to puncture the membrane and cause the hair coloring chemicals to be mixed together. In another embodiment, the device contains two or more hair coloring chemicals, at least one in at least one receptacle within the device. The device further comprises a cutting member in the form of a cursor, pull-member, rotatable element, or push-member to cut open the receptacle(s) within the device to release and thereby mix the hair coloring chemicals. The device can include an applicator removably attached to the housing to apply the mixed hair coloring chemicals.

5 Claims, 22 Drawing Sheets

(56) References Cited

U.S. PATENT DOCUMENTS

| | | | |
|---|---|---|---|
| 7,322,365 | B2 | 1/2008 | Kelloyan |
| 2002/0042958 | A1 | 4/2002 | Orr |
| 2005/0081874 | A1 | 4/2005 | Mathiez |
| 2006/0021996 | A1 | 2/2006 | Scott |
| 2008/0237258 | A1 | 10/2008 | Green |
| 2008/0302380 | A1 | 12/2008 | Morales |

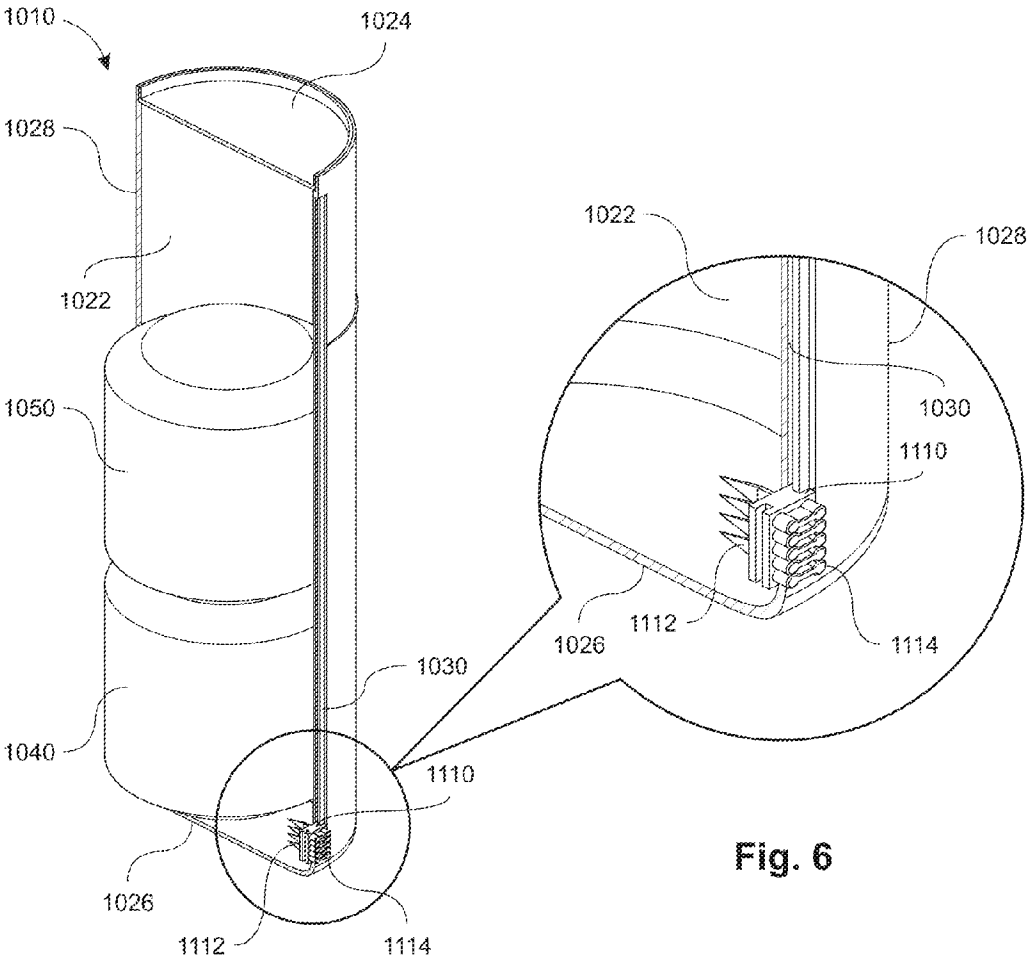
Fig. 5
Fig. 6
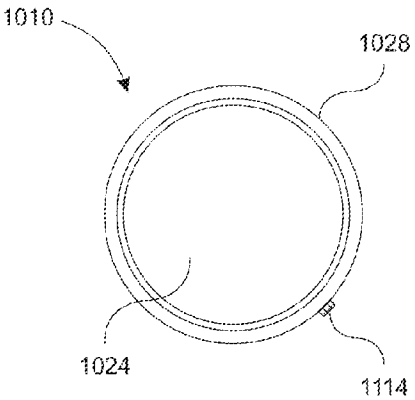
Fig. 4

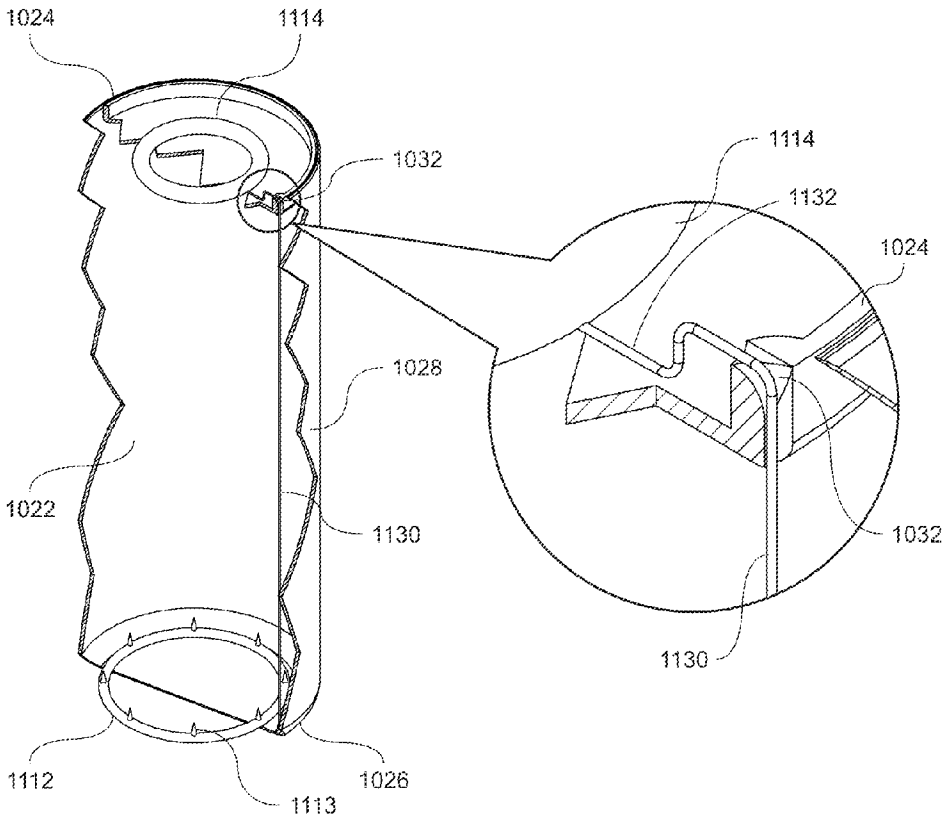
Fig. 27
Fig. 26
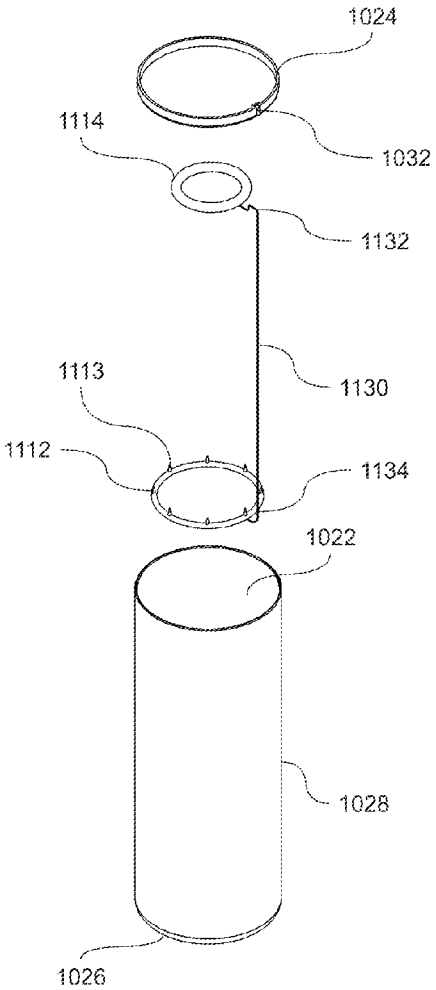
Fig. 25

DEVICE AND METHOD FOR MIXING HAIR COLORING CHEMICALS

CROSS-REFERENCE TO RELATED APPLICATIONS

This application claims priority to International Application Serial No. PCT/US2011/021439 filed on Jan. 15, 2011, which is hereby incorporated by reference in its entirety.

BACKGROUND OF THE INVENTION

1. Field of the Invention

The invention herein relates to a device and method for mixing and applying hair coloring chemicals to a user's hair.

2. Background Information

Hair coloring is commonly used to provide more fashionable or desirable looks. A number of different types of hair coloring are known, among which temporary hair color, semi-permanent hair color, demi-permanent hair color, and permanent hair color are the most common types. Temporary hair color can be obtained through rinses, shampoos, gels, sprays, and foams and lasts only from one shampoo to the next because color particles are deposited on the outside of the hair shaft. Semi-permanent hair color contains no or very low levels of developer, peroxide or ammonia, and the color usually lasts up to 4-5 shampoos because the pigment molecules can partially penetrate the hair shaft. Demi-permanent hair color contains a developer and an alkaline agent other than ammonia, and the color typically lasts up to 20-28 shampoos. Permanent hair color contains an alkalizing agent ammonia and a developer, the concentration of which is higher than the concentration of developer used in demi-permanent hair color. The permanent hair color will not wash out and is the only way to dye dark hair into a lighter shade.

A developer used in demi-permanent hair color and permanent hair color is an oxidizing agent that opens the cuticle to allow the color to penetrate the cuticle layer. Typically, hydrogen peroxide is used as a developer.

SUMMARY OF THE INVENTION

In one embodiment, a method of mixing and applying hair coloring chemicals to a user's hair of the present invention generally comprises: providing a device which comprises a first compartment holding a brush applicator in a locked position, a second compartment containing a developer or oxidizing agent and being connected to the first compartment, a membrane enclosing an end of the second compartment, and a locking member preventing the brush applicator from contacting the membrane; selecting a desired color to be applied to a user's hair; putting the color in a third compartment; attaching the third compartment containing the color to the device; rotating the first compartment relative to the second compartment to remove the locking member so as to release the brush applicator from the locked position; moving the brush applicator toward the membrane to puncture the membrane so that the membrane retracts to a peripheral edge of the membrane to cause the developer and the color to be mixed together; scooping the mixed developer and color out of the device using the brush applicator; and combing the user's hair by the brush applicator with the mixed developer and color thereon, thereby applying the mixed developer and color to the user's hair.

In another embodiment, the present invention directed to a device for mixing and applying hair coloring chemicals to hair generally comprises a housing containing a first hair coloring chemical, wherein the housing comprises an interior portion, a first end, a second end, and at least one wall enclosing the interior portion. The housing can contain at least one first hair coloring chemical and the receptacle(s) located within the interior portion of the housing can contain at least one second hair coloring chemical. Alternatively, the housing is empty and both the first and second hair coloring chemicals are contained in one two or more compartments. A cutting member movably secured to the housing and is capable of cutting open the receptacle(s) when moved and thereby releasing the at least one second hair coloring chemical from the at least one receptacle to mix with the first hair coloring chemical within the housing or released from another compartment that has been cut open.

In one embodiment, the wall of the device further comprises a track. The cutting member in this embodiment comprises a cursor having a cutting edge and a handle and fitting and sliding within the track. The cutting edge is sealably fitted within the interior portion of the housing and the handle is at least partially outside of the housing. The cutting edge slices open at least one receptacle when the cursor is moved thereby releasing at least one second hair coloring chemical from the at least one receptacle to mix with the first hair coloring chemical within the housing or released from another compartment that has been cut open.

In another embodiment, the first end of the housing of the device comprises an aperture therethrough. The cutting member comprises a cursor, wherein the cursor comprises an inner arm and an outer arm. The inner arm and the outer arm are connected outside the housing. The inner arm further comprises a cutting edge and extends from within the interior portion through the aperture and outside the housing, while the outer arm further comprises a handle and is located outside of the housing. The cutting edge slices open at least one receptacle when the cursor is moved thereby releasing at least one second hair coloring chemical from the at least one receptacle to mix with the first hair coloring chemical within the housing or released from another compartment that has been cut open.

In another embodiment the first end of the housing includes an aperture therethrough. The cutting member comprises a pull-member having a first end and a second end that extends through the aperture. The pull-member and the aperture are sealably fitted with one another. The first end of the pull-member comprises a handle outside of the housing and the second end of the pull-member comprises a cutting edge within the interior portion of the housing. The cutting edge of the pull-member is capable of cutting open the at least one receptacle when the pull-member is pulled thereby releasing the at least one second hair coloring chemical from the at least one receptacle to mix with the first hair coloring chemical within the housing or released from another compartment that has been cut open. The wall of the device can have an interior surface with at least a first and second elevation, where the pull-member is capable of sliding along the interior surface where the first and second elevations meet. Further, the cutting edge is capable of detaching from the pull-member.

In another embodiment, the first end of the housing includes a first aperture and a second aperture. The cutting member comprises a pull-member having a first leg, a second leg where the first leg extends through the first aperture, and the second leg extends through the second aperture. The first and second legs are connected within the interior portion to form a cutting edge. The pull member has a handle at least partially outside of the housing and connected to at least one of the first and second legs for manipulating the pull-member. The pull-member is capable of cutting open the at least one receptacle thereby releasing the at least one second hair coloring chemical from the at least one receptacle to mix with the first hair coloring chemical within the housing or released from another compartment that has been cut open.

In another embodiment, the cutting member comprises a rotatable element. The rotatable element can be inset within an end of the device. The rotatable element is rotatably attached to the first end of the housing and includes at least one arm extending from the rotatable element. The arm includes a cutting edge and can further include an agitator. The cutting edge is capable of cutting open the at least one receptacle when the rotatable element is rotated thereby releasing the at least one second hair coloring chemical from the at least one receptacle to mix with the first hair coloring chemical within the housing or released from another compartment that has been cut open. The rotatable element can further comprise an outer perimeter wall and an inner skirt, where the inner skirt defines an opening capable of receiving an applicator. The device can further include a cap capable of covering the rotatable element and removably attached to the housing. In one embodiment, the cap is removably attached to the housing by a threaded portion on each the cap and housing. The outer perimeter wall of the rotatable element can include at least one recessed portion that is engaged by at least one projecting element on an interior surface of the cap. The at least one projecting element engages at least one recessed portion, thereby rotating the rotatable element when the cap is rotated.

In another embodiment, the cutting member comprises a cut-out portion on at least one wall of the device. The cut-out portion comprises a cutting edge and the device further comprises a flexible sheath capable of sealing at least the cut-out portion. The cutting edge is capable of cutting open the at least one receptacle when the cut-out portion is depressed thereby releasing the at least one second hair coloring chemical from the at least one receptacle to mix with the first hair coloring chemical within the housing or released from another compartment that has been cut open.

In yet another embodiment the cutting member further comprises a push member having at least one projecting element. The at least one wall includes at least one aperture capable of receiving the at least one projecting element. The device further comprises a shield capable of sealing the at least one aperture and guiding the at least one projecting element through the at least one aperture. The at least one projecting element punctures at least one receptacle when the push member is pushed thereby releasing the at least one second hair coloring chemical from the at least one receptacle to mix with the first hair coloring chemical within the housing or released from another compartment that has been cut open.

The first hair coloring chemical of the aforementioned embodiments can be a developer or oxidizing agent and the second hair coloring chemical can be a color or vice versa. The device can include a detachable applicator to apply the mixture of hair coloring chemicals to hair.

Another method of mixing and applying hair coloring chemicals to a user's hair of the present invention generally comprises: providing a device as described above, moving the cutting member to cut the at least one compartment of the device and thereby mix the hair coloring chemicals, and applying a mixture of the hair coloring chemicals to hair. For example, the user can slide the cursor member, pull the cursor or pull-member, rotate the rotatable element, or push the cut-out portion or push member to open the at least one receptacle within the device. Several embodiments of the device require shaking the device after moving the cutting member, while other embodiments of the device do not require shaking the device to mix the hair coloring chemicals. The mixture can be removed from the device and applied to hair using an applicator having a handle and a brush. The user can comb the hair with the brush applicator to apply the mixture of hair coloring chemicals.

BRIEF DESCRIPTION OF THE DRAWINGS

FIG. 4 is an end view of an embodiment of the present invention having a cursor cutting member.

FIG. 5 is a cross-sectional view of an embodiment of the present invention having a cursor cutting member.

FIG. 6 is an enlarged cross-sectional view of a cursor cutting member of the present invention.

FIG. 25 is an exploded, disassembled view of an embodiment of the present invention having a pull-member FIG. 26 is a transparent view of an embodiment of the present invention having a pull-member.

FIG. 27 is an enlarged view of an aperture and pull-member of an embodiment of the present invention having a pull-member.

DETAILED DESCRIPTION OF THE INVENTION

Figure 1:
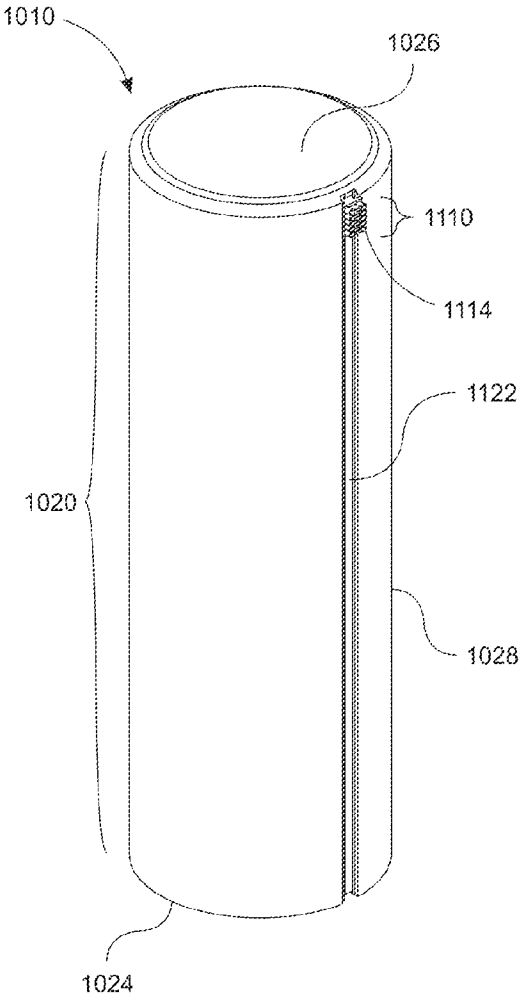
FIG. 1 is a perspective view of an embodiment of the present invention having a cursor cutting member.
Figure 69:
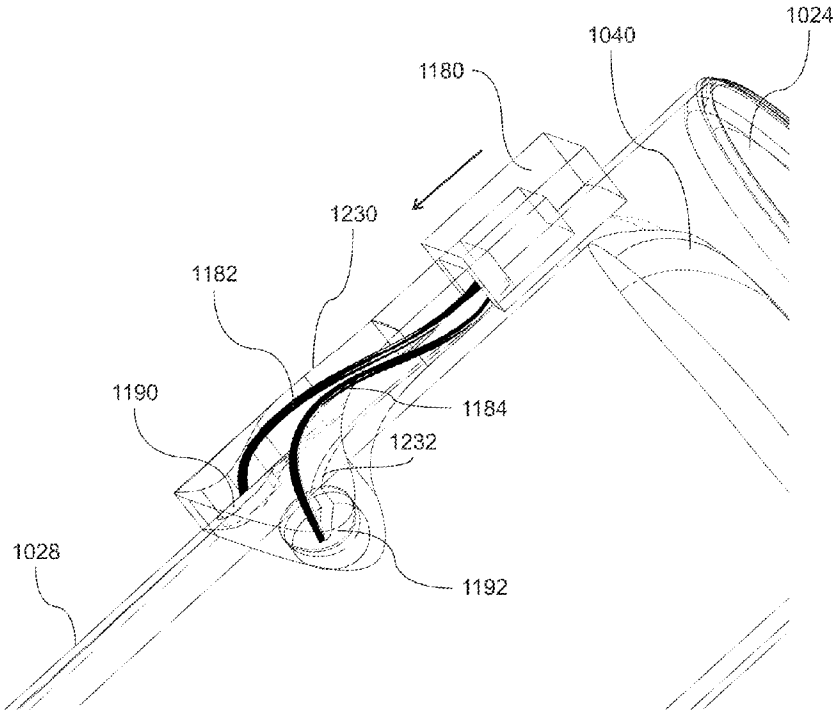
FIG. 69 is an enlarged, transparent, perspective view of an embodiment of the present invention having a push member and a shield.

FIGS. 1 through 69 illustrate further embodiments of the present invention directed to a device 1010 and method for mixing and applying hair coloring chemicals to a person's hair. These embodiments and methods are different from the aforementioned devices and methods in that they include different storing receptacles, cutting mechanisms and methods of mixing the hair coloring chemicals.

The device 1010 generally comprises a housing 1020 and one or more receptacle(s) 1040, 1050 that separately contain one or more hair coloring chemical(s). The housing 1020 itself can also contain a hair coloring chemical. The device 1010 also comprises a cutting member 1100 that cuts open the receptacle(s) 1040, 1050 within the device 1010 when it is moved, which thereby creates a mixture of the hair coloring chemicals previously separately contained therein. A user of the device 1010 can thereafter apply the mixture to hair. The user can apply the mixture with an applicator 1016 having a handle 1018 and brush 1017 that is removably attachable to the device 1010. In all embodiments described herein, the housing 1020 can be reusable and the receptacle(s) 1040, 1050 can be replaceable.

As described in more detail below, the cutting member 1100 can be comprised of a cursor 1110, a trumpet cursor 1110, a pull-member 1130 such as a pull-ring, a twistable or rotatable element 1140, a cut-out portion 1160, or a push member 1180. Further, the receptacle(s) 1040, 1050 are preferably made of a retractable elastomeric material to promote mixing and easily open when sliced, torn, or otherwise cut open by the cutting member 1100. Overall, the different embodiments of the cutting member 1100 described herein, as well as the elastomeric properties of the receptacle(s) 1040, 1050, provide for quicker and more thorough mixing of the hair coloring solutions compared to those devices known in the prior art.

The device 1010 should not be limited in scope to the specific embodiments illustrated herein. The device 1010 can be made in multiple sizes, shapes, and hold different amounts of fluid. As a non-limiting example, the device 1010 can have a cylindrical shape.

In general terms, the device 1010 for mixing and applying hair coloring chemicals to a person's hair comprises a housing 1020 having an interior portion 1022, a first end 1024, a second end 1026, and at least one wall 1028 enclosing said interior portion 1022. As used herein, the first end 1024 and second end 1026 shall not be limited to describe the top and bottom of the device 1010 or vice versa. In some embodiments, either the first end 1024, second end 1026, or both ends are removably attached with the at least one wall 1028.

At least one receptacle 1040 containing a hair coloring chemical is enclosed within said interior portion 1022 of said housing 1020 such that least two hair coloring chemicals are contained separately within the device 1010. In some embodiments, the housing 1020 can contain a free-floating first hair coloring chemical and the receptacle(s) 1040, 1050 can contain a second hair coloring chemical. In other embodiments, the housing 1020 does not hold a free-floating hair coloring chemical. In such an embodiment, two or more hair coloring chemicals 1012, 1014 are contained in two or more receptacle(s) 1040, 1050 within the housing 1020. For example, a first hair coloring chemical can be contained in a first receptacle and a second hair coloring chemical can be contained in a second receptacle. All embodiments of the device 1010 include at least one receptacle 1040 or can contain two or more receptacle(s) 1040, 1050.

The hair coloring chemicals can be developers, oxidizing agents and/or hair colors or dyes. For example, the first hair coloring chemical can be a developer or oxidizing agent and the second hair coloring chemical can be a color, or vice versa.

In addition, the device 1010 includes a cutting member 1100 is movably attached with the housing 1020 to cut open the receptacle(s) 1040, 1050 when it is moved, thereby releasing the hair coloring chemical from at least one receptacle 1040 to mix with the hair coloring chemical within the housing 1020 or another receptacle 1050 contained within the housing 1020.

Most components of the device 1010, such as the housing 1020 and applicator 1016, can be comprised of commodity thermoplastics and can be made by injection molding, with the exception of the receptacle(s) 1040, 1050 made of elastomeric materials. The housing 1020 of the device 1010 can be made of a material that is substantially chemically resistant and suitable for holding a hair coloring chemical making skin contact under FDA standard. For example, the housing 1020 can be made of polypropylene (PP), polyethylene terephthalate, high-impact poly styrene (HIPS), high-density polyethylene (HDPE), polycarbonate, polyvinyl chloride, and acrylonitrile butadiene styrene (ABS). The device 1010 can be made of any type of material or plastic so long as they provide resistance to peroxides and are safe for human use. Most of the components, such as those made of thermoplastics, can also be made by extrusion, blow-molding, or stretch molding.

The one or more receptacle(s) 1040, 1050 of the device 1010 described herein generally refers to a sealed container, pouch, casing, envelope, enclosure or package that contains one or more hair chemicals to be mixed when the receptacle(s) 1040, 1050 are broken open. The receptacle(s) 1040, 1050 can be made flexible, highly adaptable, and comprise an elastomeric material. The receptacle(s) 1040, 1050 can be made of a material that is substantially chemically resistant to hydrogen peroxide attack and allows for retraction of the membrane upon puncture. The receptacle(s) 1040, 1050 can be made by a dip molding process or a suitable method of manufacture known in the art. Examples of elastomeric materials that can be used include a low-creep moldable thermoplastic elastomeric polymer, such as polyolefin blends, elastomeric alloys, thermoplastic polyurethanes, and thermoplastic copolyesters. Additional elastomeric materials include latex (including natural and synthetic blends like Vytex® natural rubber latex and polyisoprene), nitrile, neoprene, polyurethane, and polyvinyl chloride (PVC). The receptacle(s) 1040, 1050 can also be made of silicone.

The elastomeric material allows for opening the blister pack receptacle(s) 1040, 1050 with ease. In addition, the elastomeric material allows for energetic release of the hair chemicals contained therein and retraction of the material once the pack is opened, which has an advantage achieving a greater homogenous mixture of the chemicals compared to known methods in the prior art.

Figure 49:
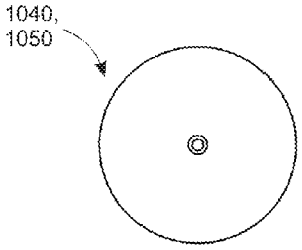
FIGS. 49-51 illustrate different views of an embodiment of a compartment in accordance with the present invention.
Figure 52:
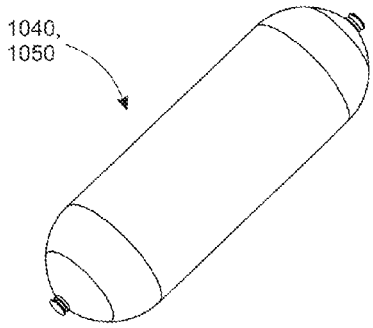
FIGS. 52-54 illustrate different views of an embodiment of a compartment in accordance with the present invention.
Figure 50:
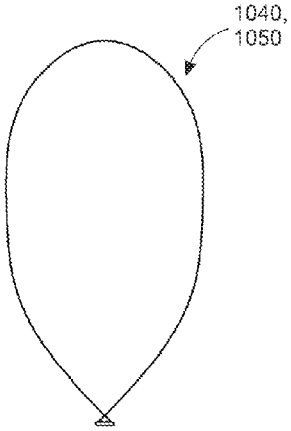
Figure 53:
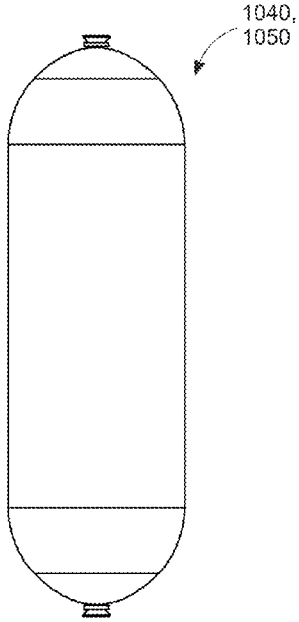
Figure 51:
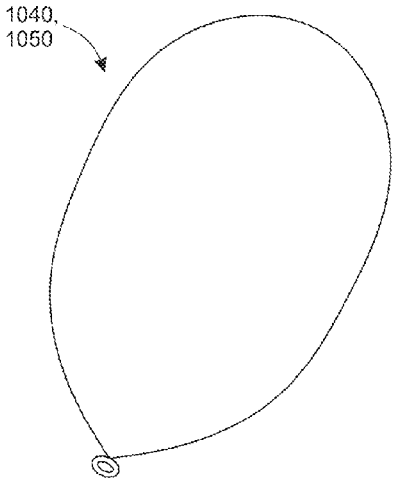
Figure 54:
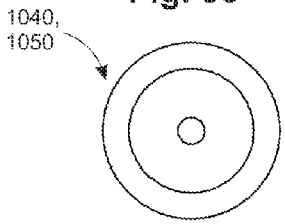
Figure 55:
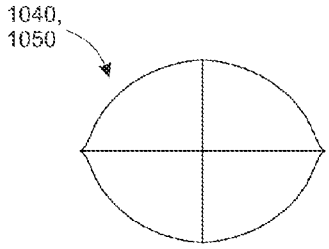
FIGS. 55-58 illustrate different views of an embodiment of a compartment in accordance with the present invention.
Figure 59:
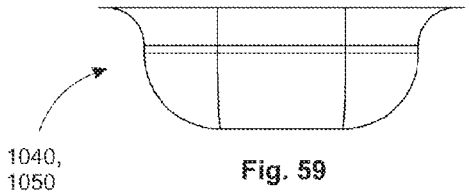
Figure 60:
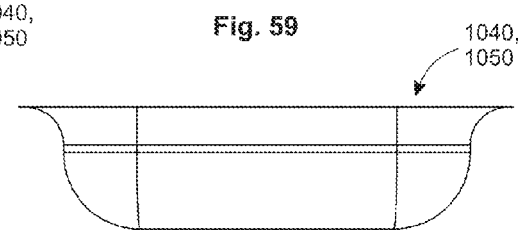
FIGS. 60-62 illustrate different views of an embodiment of a compartment in accordance with the present invention.
Figure 56:
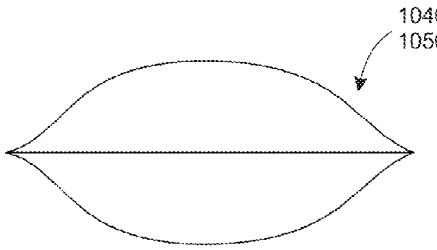
Figure 61:
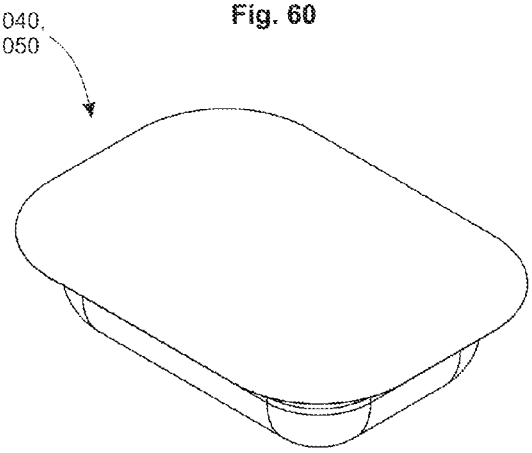
Figure 57:
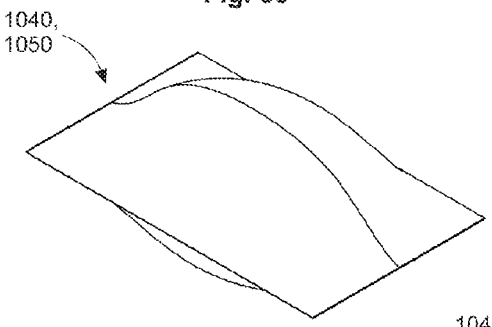
Figure 58:
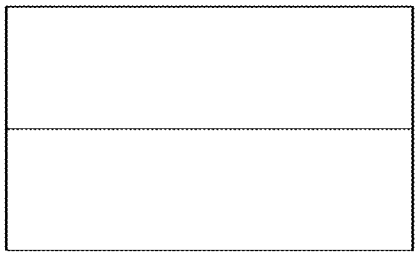
Figure 62:
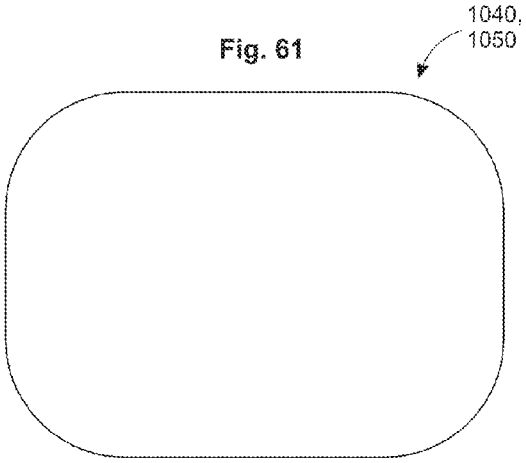

The receptacle(s) 1040, 1050 can be comprised of any shape, including balloons, sealed pouches, packages, envelopes, sheets that are chemically connected (either by bonding of the elastic material to itself through heat or ultrasonic movement, or by a separate chemical bonding agent), sheets that are mechanically connected (e.g., staple, wire, etc.), and sheets that are twisted to remain held together (similar to casings used for sausage). In an embodiment shown in FIGS. 49-51, the receptacle(s) 1040, 1050 are elastomeric blister packs.

Figure 30:
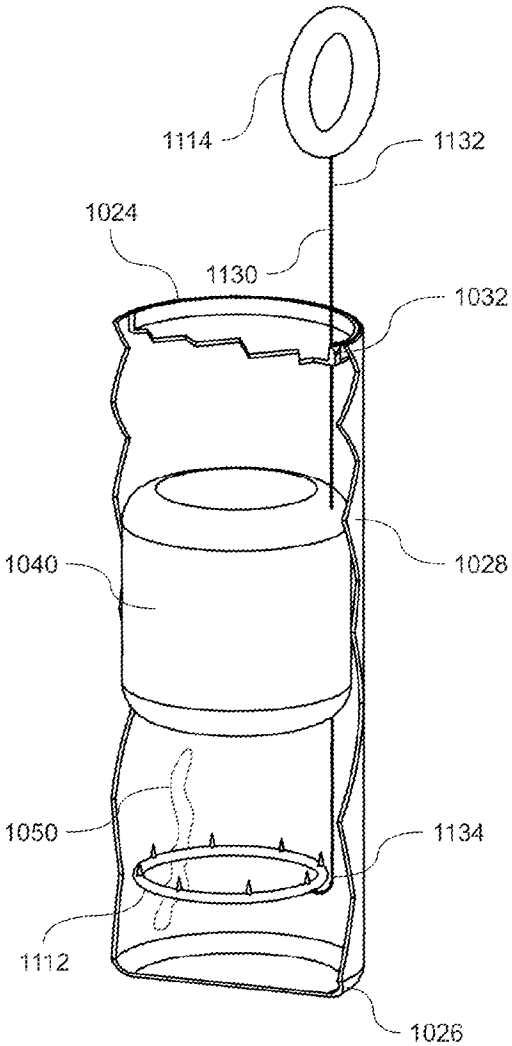
FIGS. 28-30 illustrate a method of using an embodiment of the present invention having a pull-member, showing transparent views of the device as the pull-member is pulled.
Figure 40:
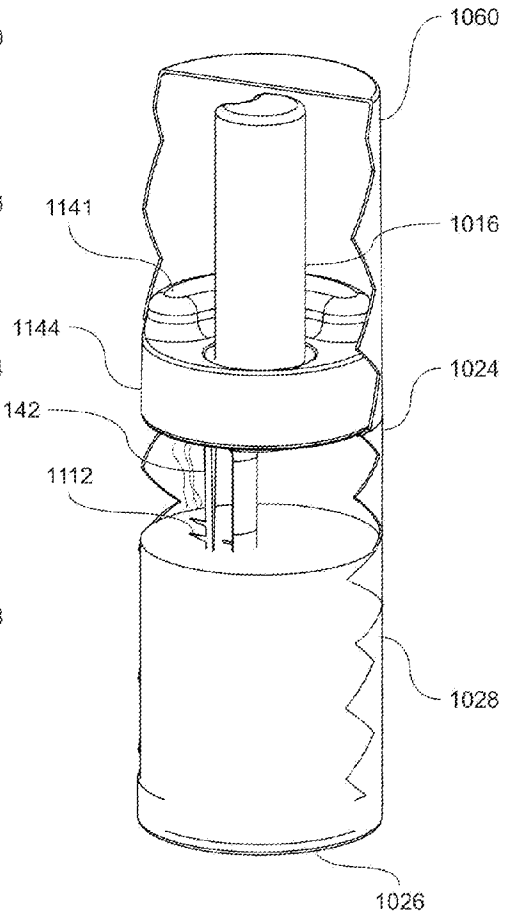
FIGS. 38-40 illustrate a method of using an embodiment of the present invention having a rotating member, showing transparent views of the device as the rotating member is rotated.

In all embodiments of the device 1010, the receptacle(s) 1040, 1050 can be attached, e.g. glued, within an inner surface 1034 of the housing 1020 of the device 1010 to maintain the receptacle(s) 1040, 1050 in a designated area to facilitate breaking, tearing, or cutting open the receptacle(s) 1040, 1050. In addition, once the receptacle(s) 1040, 1050 are cut open, they remain attached to a wall 1028 of the device 1010 rather than free-floating within the colorant mixture. Attachment of the receptacle(s) 1040, 1050 to the device 1010 can lessen obstruction to further promote mixing of the hair coloring solutions within the device 1010. As shown in FIGS. 30 and 40, in embodiments where the receptacle(s) 1040, 1050 have been pre-attached to a wall 1028, once the receptacle(s) 1040, 1050 are cut open and deflated, the receptacle(s) 1040, 1050 remain held to the wall 1028.

The receptacle(s) 1040, 1050 can be attached during manufacture of the device 1010 or by the user prior to using the device 1010. The receptacle(s) 1040, 1050 may be chemically or mechanically attached to a wall 1028 of the device 1010 prior to use. For example, the receptacle(s) 1040, 1050 can be adhesively attached to the wall 1028 by a small strip of glue or other suitable adhesive. In another embodiment, the receptacle(s) 1040, 1050 can be heat-sealed by melting a portion of the elastomeric material to a wall 1028 of the device 1010.

An applicator 1016 can be removably attached or incorporated into the device 1010 in an internal or external manner. In one embodiment, an applicator 1016 is attached to an external side of the housing 1020 of the device 1010. For example, the applicator 1016 can be slidably attached along a groove on a wall 1028 of the housing 1020. The applicator 1016 can be inset in the housing 1020 to allow space-saving storage of the device 1010. The applicator 1016 can be incorporated into the first end 1024 or second end 1026 of the device 1010. FIGS. 33-44 illustrate one embodiment of the applicator 1016. The applicator 1016 can be hollow or solid and comprise a brush 1017 on one end and a handle 1018 on an opposite end. In one embodiment, the brush 1017 extends from the applicator 1016 such that the brush 1017 is off-centered or situated away from the center of the handle 1018. The handle 1018 or brush 1017 of the applicator 1016 can further comprise a tip 1015 that is pointed or rounded. The tip 1015 can serve as a hair pick.

The brush 1017 of the applicator 1016 can extend to the bottom of the device 1010. The handle 1018 of the applicator 1016 can further comprise at least one recess 1013, such as a ribbed area, to alleviate spills and other unwanted liquid conditions. In addition, the ribbed area can provide a non-visual guide to the user for hand placement to properly hold the applicator 1016 with a decreased chance of spilling liquids on the user's hands. In another embodiment, the at least one recess formed on the handle 1018 of the applicator 1016 can facilitate attaching the applicator 1016 within the device 1010.

The device 1010 can employ several different cutting members 1100 to cut open the receptacle(s) 1040, 1050 that contain hair coloring chemical(s) within the device 1010. In one embodiment, the cutting member 1100 is a cursor 1110 that slides along a track 1030 on a wall 1028 of the housing 1020 to cut open one or more receptacle within the housing 1020. In another embodiment, the cutting member 1100 is a pull-member 1130 that slides through a hole in one end of the housing 1020 which cuts through one or more receptacle(s) 1040, 1050 within the housing 1020 as the pull-member 1130 is pulled though the hole fitted around the pull-member 1130. In an embodiment, the cutting member 1100 is a rotatable element 1140 on one end of the device 1010 that includes a cutting edge 1112 to cut open the one or more receptacle(s) 1040, 1050 within the housing 20 when the rotatable member is rotated. Each cutting member 1100 and corresponding cutting mechanism is described in further detail below.

Embodiments of the Present Invention Having a "Cursor" Cutting Member

Figure 3:
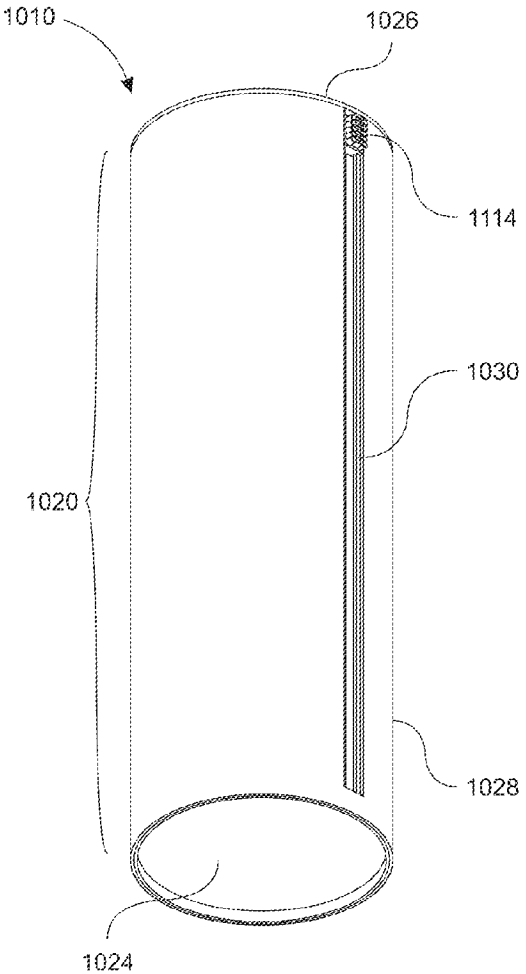
FIG. 3 is a perspective view of an embodiment of the present invention having a cursor cutting member.
Figure 2:
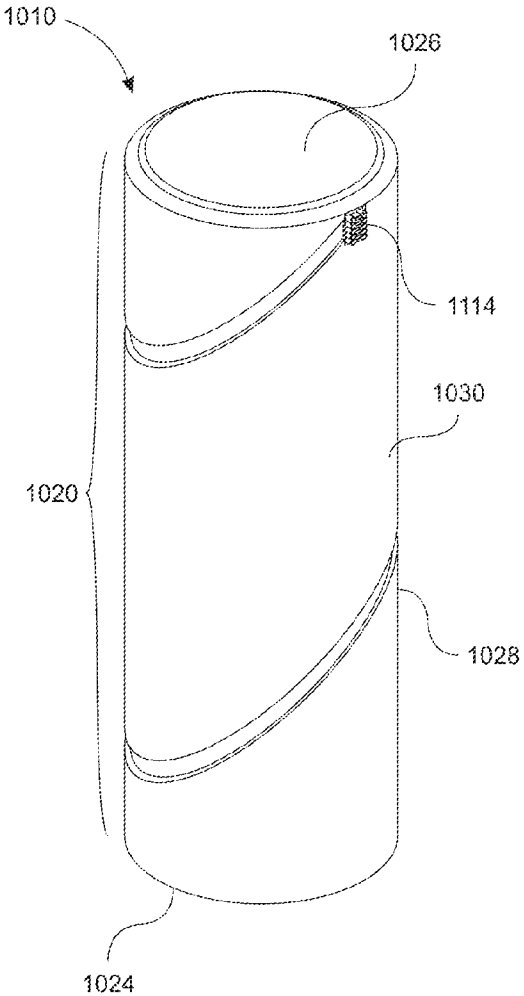
FIG. 2 is a perspective view of an embodiment of the present invention having a cursor that rotates around the housing of the device.
Figure 16:
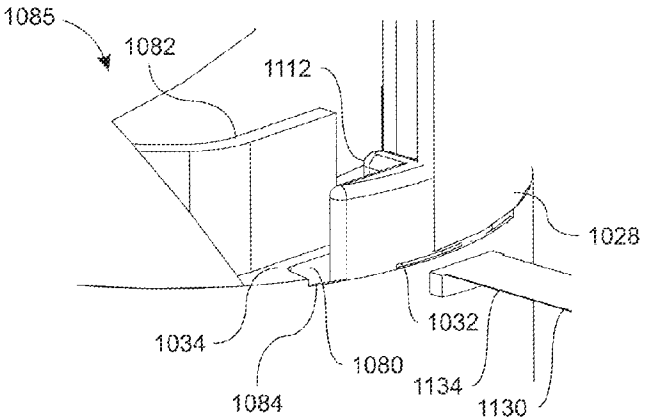
Figure 18:
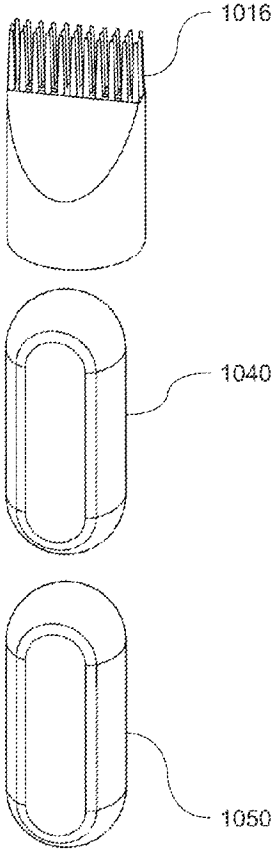
FIG. 18 is a perspective view of an embodiment of the present invention having a pull-member, illustrated with the structural elements thereof disassembled.
Figure 18:
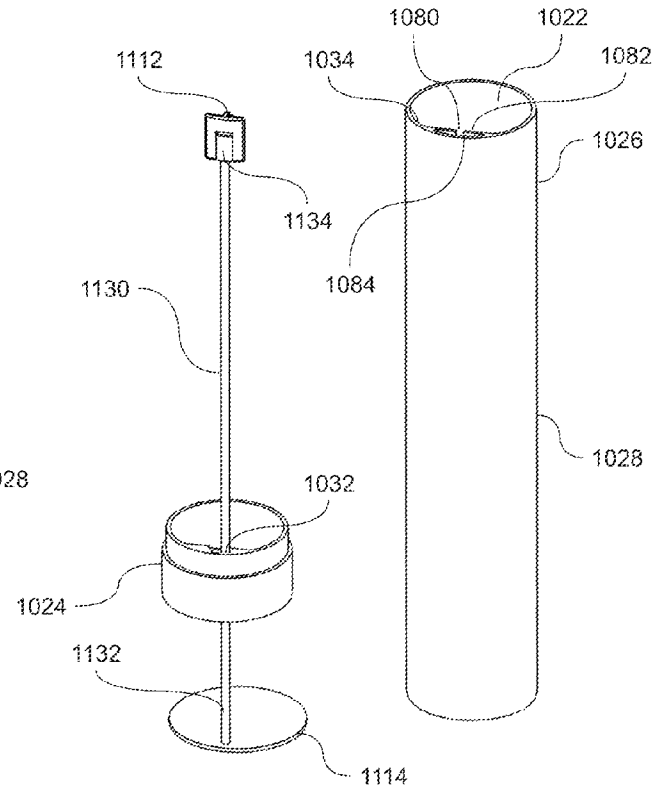
Figure 17:
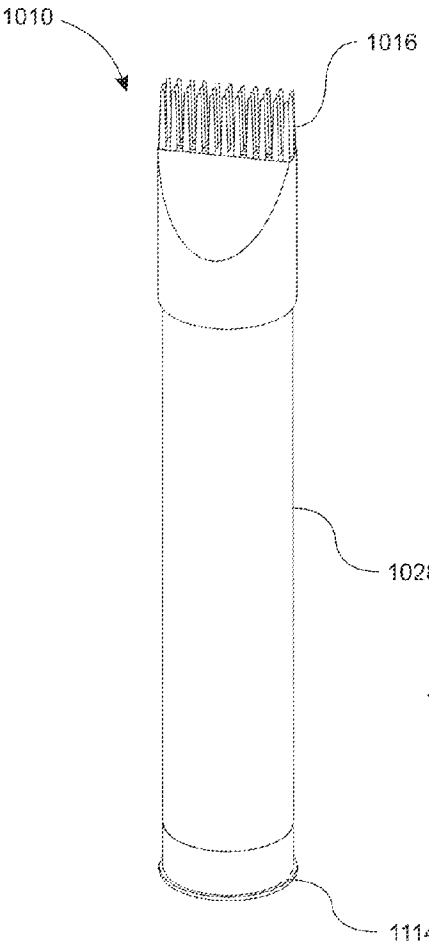
FIG. 17 is a perspective view of an embodiment of the present invention having a pull-member.
Figure 21:
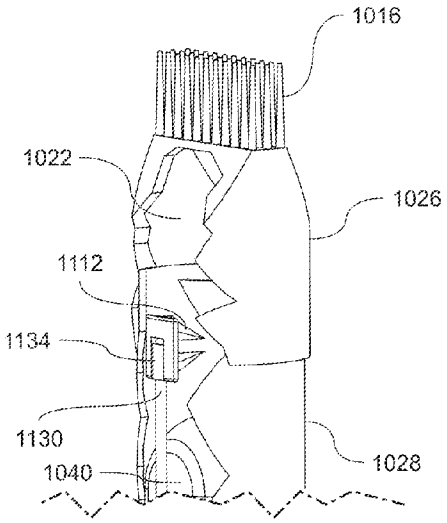
FIGS. 20-21 are enlarged, transparent, perspective views of a pull-member of a device according to the present invention.
Figure 20:
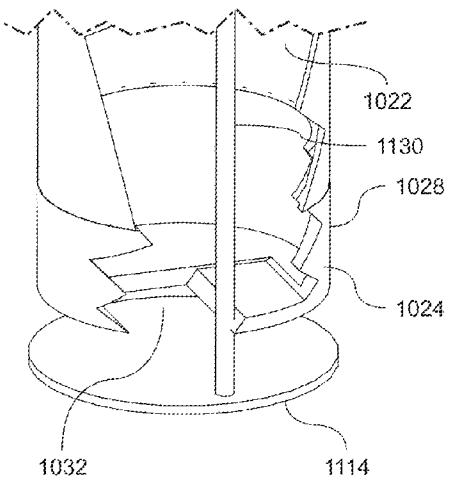
Figure 19:
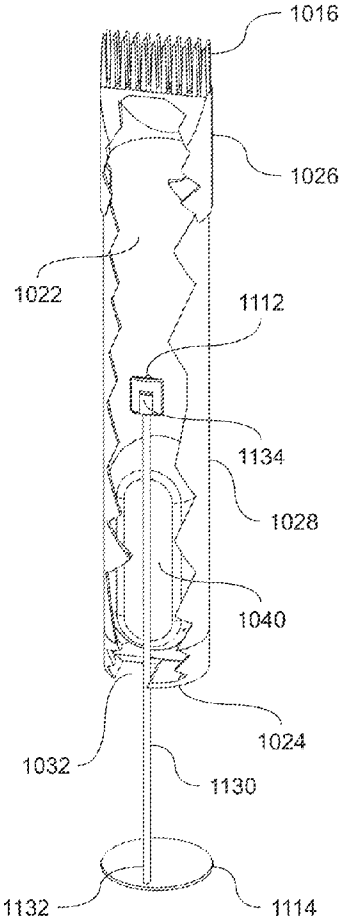
FIG. 19 is a transparent, perspective view of an embodiment of the present invention having a pull-member.
Figure 24:
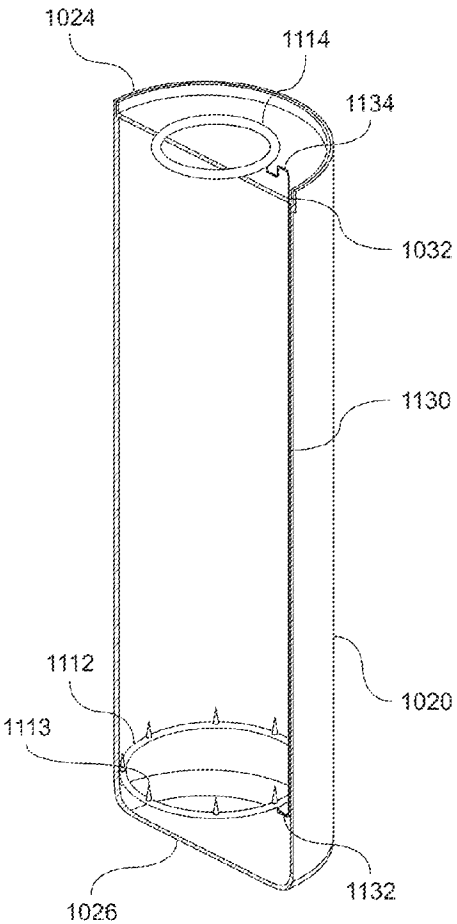
FIGS. 22-24 are transparent, perspective views of an embodiment of the present invention having a pull-member.

As shown in FIGS. 1-6, embodiments using a cursor 1110 cutting member 1100 can include a track 1030 that runs along a wall 1028 of the device 1010. The cursor 1110 is capable of fitting and sliding within the track 1030. The cursor 1110 and track 1030 can engage one another in any non-limiting manner. For example, the cursor 1110 can include a recess to accept a protrusion from the track 1030, or vice versa. The cursor 1110 and track 1030 can rotate around the device 1010 as shown in FIG. 2, or can run along one side of the device 1010 as shown in FIGS. 1 and 2-6. The cursor 1110 further comprises a cutting edge 1112 that is situated within the housing 1020 to cut open the receptacle(s) 1040, 1050 within the housing 1020 and a handle 1114 that is situated outside the housing 1020 so that a user can manipulate the cursor 1110. As shown in FIG. 16, the handle 1114 and cutting edge 1112 can extend from the cursor 1110 perpendicular to axis of movement of cursor 1110.

The cursor 1110 can be sealably fitted within said interior portion 1022 of said housing 1020 to prevent leaks from the device 1010. In addition or alternatively, the cursor 1110 can further comprise a sliding extendable shield 1122 that runs behind the cursor 1110 in the track 1030 to prevent leakage of liquids from the device 1010 and seal liquids within the device 1010. The shield 1122 can remain closed to maintain a seal sufficient to prevent leakage of liquids from the device 1010.

Figure 7:
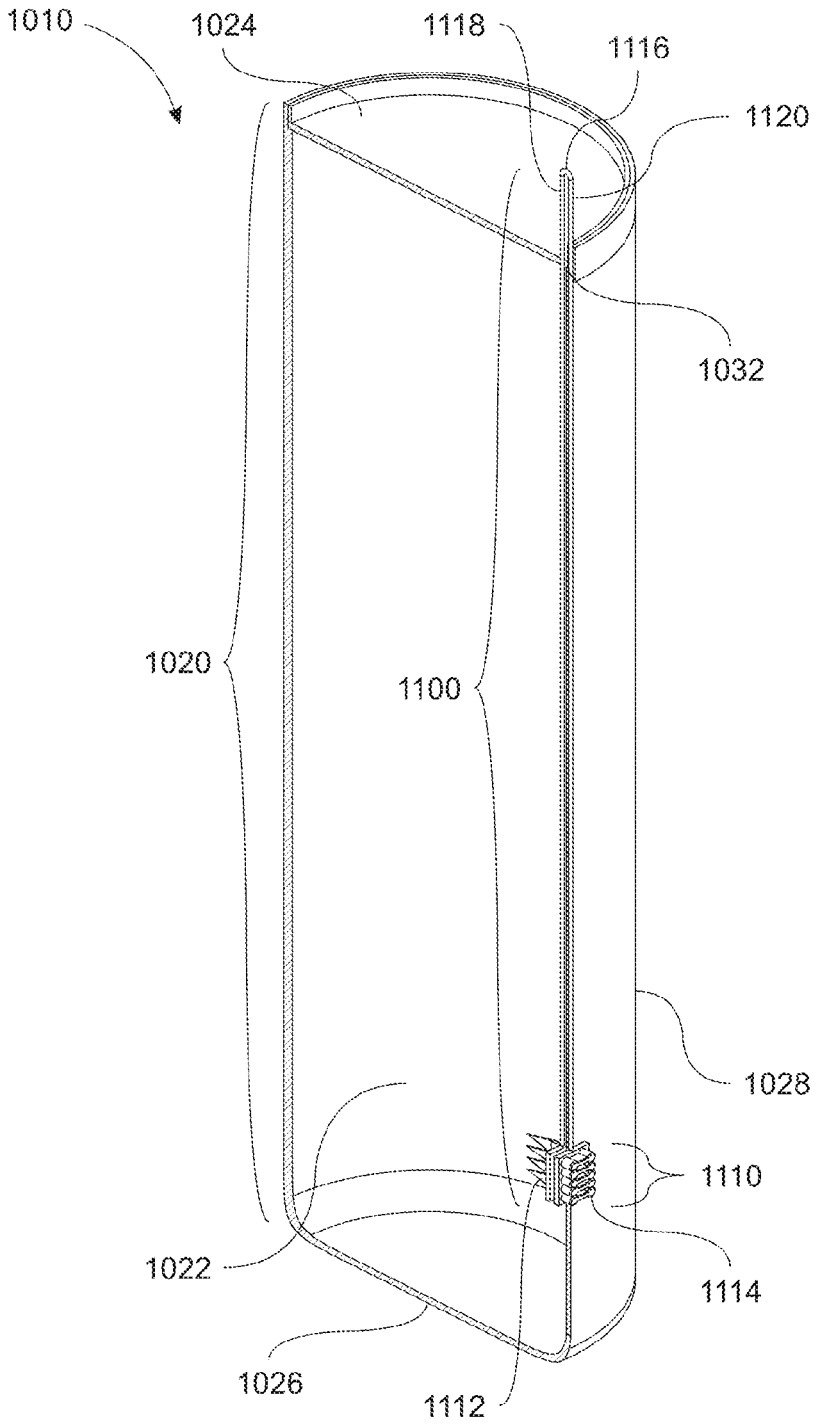
FIG. 7 is a cross-sectional view of an embodiment of the present invention having a cursor that moves through an aperture.
Figure 8:
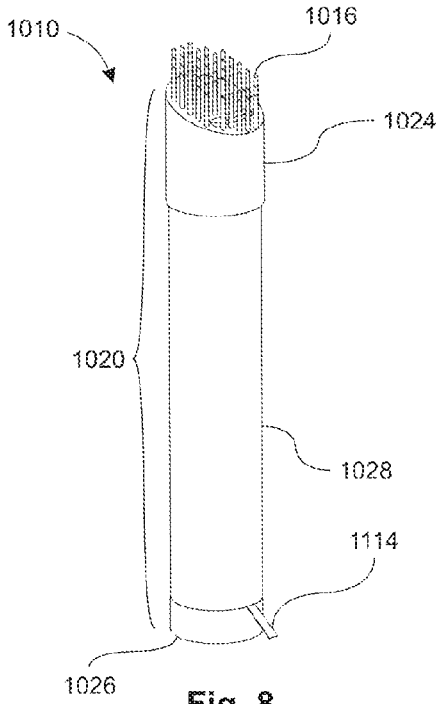
FIG. 8 is a perspective view of an embodiment of the present invention having a pull-member cutting member.
Figure 9:
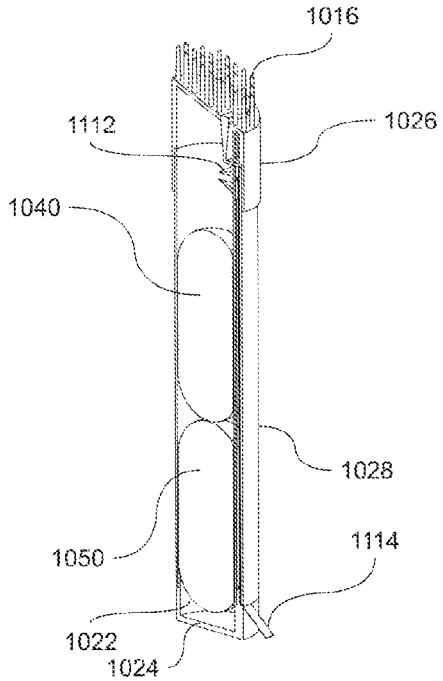
FIG. 9 is a cross-sectional view of an embodiment of the present invention having a pull-member.
Figure 10:
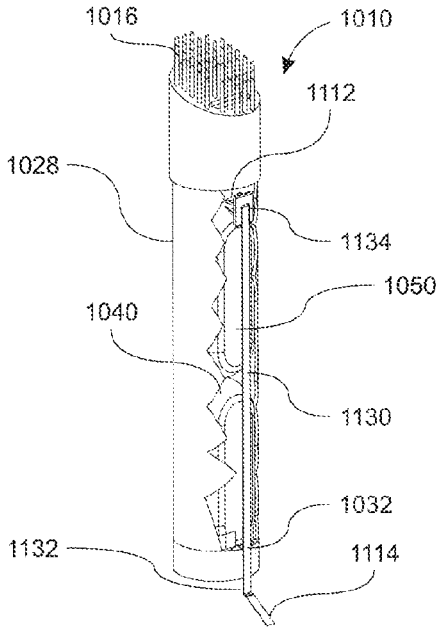
FIG. 10 is a transparent view of an embodiment of the present invention having a pull-member.
Figure 11:
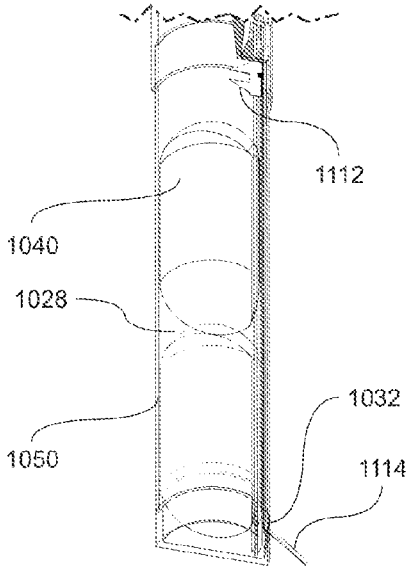
FIG. 11 is a cross-sectional view of an embodiment of the present invention having a pull-member.

The cutting edge 1112 of the cursor 1110 cuts open the at least one receptacle 1040 within the housing 1020 when the cursor 1110 is moved along the track 1030 such that the hair coloring chemical is released from the at least one receptacle 1040 to mix with another hair coloring receptacle in a second receptacle or within the housing 1020. The cutting edge 1112 can be comprised of a blade, a serrated blade, projecting spikes, or another sharp structure capable of cutting open the receptacle(s) 1040, 1050 within the housing 1020. A user of the device 1010 can grasp the handle 1114 which projects from the housing 1020 to slidably move the cursor 1110 from one end of the device 1010 toward the other end, while the cutter edge will cut through the receptacle(s) 1040, 1050 within the interior portion 1022 of the housing 1020 and thereby mix hair coloring chemicals in each. If desired, the user can then shake the device 1010 and open the device 1010 to apply the mixture of hair coloring chemicals to hair In another embodiment illustrated in FIG. 7, the device 1010 using a cursor 1110 as a cutting member 1100 can include an aperture 1032 through one end of the housing 1020. The cursor 1110 further comprises an inner arm 1118 and an outer arm 1120 connected outside the housing 1020. The inner arm 1118 includes a cutting edge 1112 and extends from within the interior portion 1022 of the device 1010, through the aperture 1032, to outside the device 1010 where it is connected with the outer arm 1120. The outer arm 1120 can comprise a handle 1114 that a user can use to move the cursor 1110. When the user moves the cursor 1110 from one end of the device 1010 to the other, the inner arm 1118 can slide through the aperture 1032 and the cutting edge 1112 can cut the at least one receptacle 1040 within the housing 1020. The aperture 1032 is sealably fitted about the inner arm 1118 such that liquids cannot escape through the aperture 1032 when the cursor 1110 is moved. The aperture 1032 can further comprise a seal to prevent leakage. Once the hair coloring chemicals are mixed within the device 1010, a user can open the device 1010 at one end to apply the mixture to hair.

Embodiments of the Present Invention Having a "Pull-member" Cutting Member

In another embodiment, the cutting member 1100 of the device 1010 is a pull-member 1130. Embodiments of the device 1010 having a pull-member are shown in FIGS. 8-30. In some embodiments, one end of the housing 1020 of the device 1010 comprises an aperture 1032 therethrough. As shown in FIGS. 8-21. The pull-member 1130 extends through the aperture 1032. The pull-member 1130 is further sealably fitted within the aperture 1032 such that the liquids within the device 1010 will not leak through the aperture 1032. The diameter and seal of the aperture 1032 around the pull-member 1130 is such that the pull-member 1130 can be cleaned of liquid as the pull-member 1130 is pulled through the aperture 1032. The pull-member 1130 further comprises a first end 1132 having a handle 1114 accessible outside the housing 1020 and a second end 1134 having a cutting edge 1112 within the interior portion 1022 of the housing 1020.

A user of the device 1010 can pull the handle 1114 of the pull-member 1130 through the aperture 1032 such that the cutting edge 1112 of the pull-member 1130 is brought towards the receptacle(s) 1040, 1050 to thereby break open the receptacle(s) 1040, 1050 either by piercing them with a sharp cutting edge 1112 structure or by bursting the receptacle(s) 1040, 1050 open by applying pressure with the pull-member 1130 on the receptacle(s) 1040, 1050. Another embodiment could include incorporating a cutting edge 1112 on a first end 1024 of the device 1010 which could sandwich the receptacle(s) 1040, 1050 and break them open. The hair coloring chemical(s) are thereby released to mix with one another. In these embodiments, a user can repeatedly dip an applicator 1016 comprising a handle 1018 and brush 1017 into the interior portion 1022 of the housing 1020 to apply the hair coloring chemical mixture to hair.

As shown in FIGS. 17-20, the handle 1114 can be inset, or removably embedded in one end of the device 1010. In one embodiment as shown in FIGS. 22-26 and 28-30, the handle 1114 of the pull-member 1130 is ring-shaped. The handle 1114 can be any shape that will allow easy grabbing of the pull-member 1130. The pull-member 1130 can be comprised of a string, strap, wire, metal, or plastic. Based on the material used, the pull-member 1130 can be flexible or inflexible. When the pull-member 1130 is inflexible, a user can move the pull-member 1130 back and forth in both directions.

Figure 29:
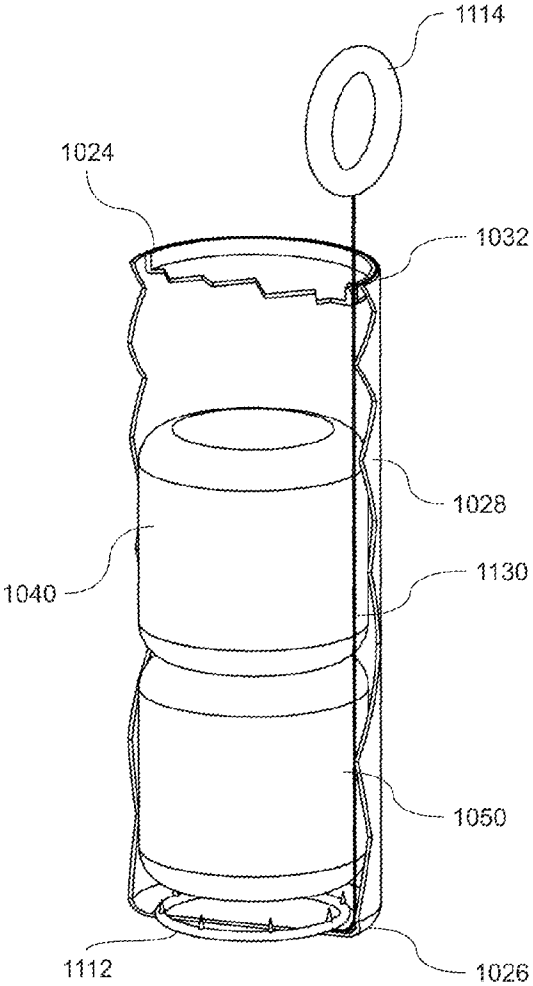
Figure 28:
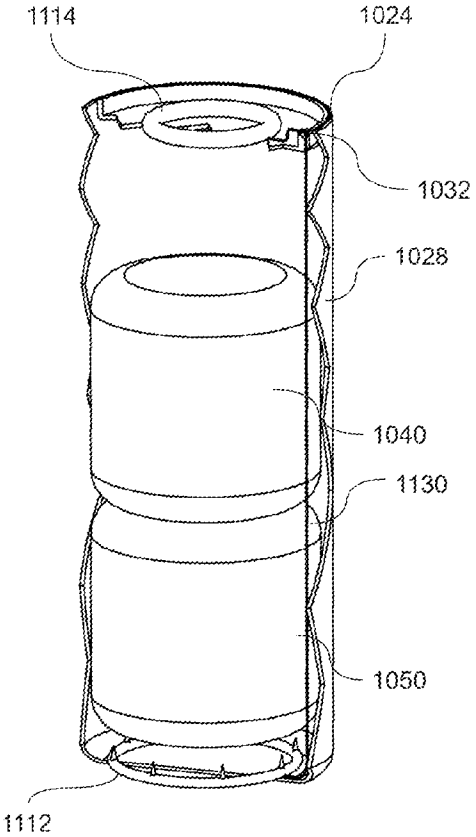

The cutting edge 1112 of the device 1010 can be in the shape of a blade, a serrated blade, projecting spikes, or another sharp structure capable of cutting open the receptacle(s) 1040, 1050 within the housing 1020. As shown in FIGS. 24-30, in a "pull-ring" embodiment, the cutting edge 1112 can be a ring with sharp projecting elements 1113 or another sharp structure capable of cutting open the receptacle(s) 1040, 1050 within the housing 1020. The cutting edge 1112 of the pull-member 1130 could comprise any shaped structure that would cause obstruction and breakage of the receptacle(s) 1040, 1050, such as a cross, a bar, a strip of plastic, or a wire. The cutting edge 1112 can be made of plastic, metal, or any material suitable for cutting open the receptacle(s) 1040, 1050 within the device 1010. As shown in FIGS. 29-30, when a user pulls the pull-member 1130, the cutting edge 1112 breaks open the receptacle(s) 1040, 1050 within the housing 1020.

Figures 12, 13:
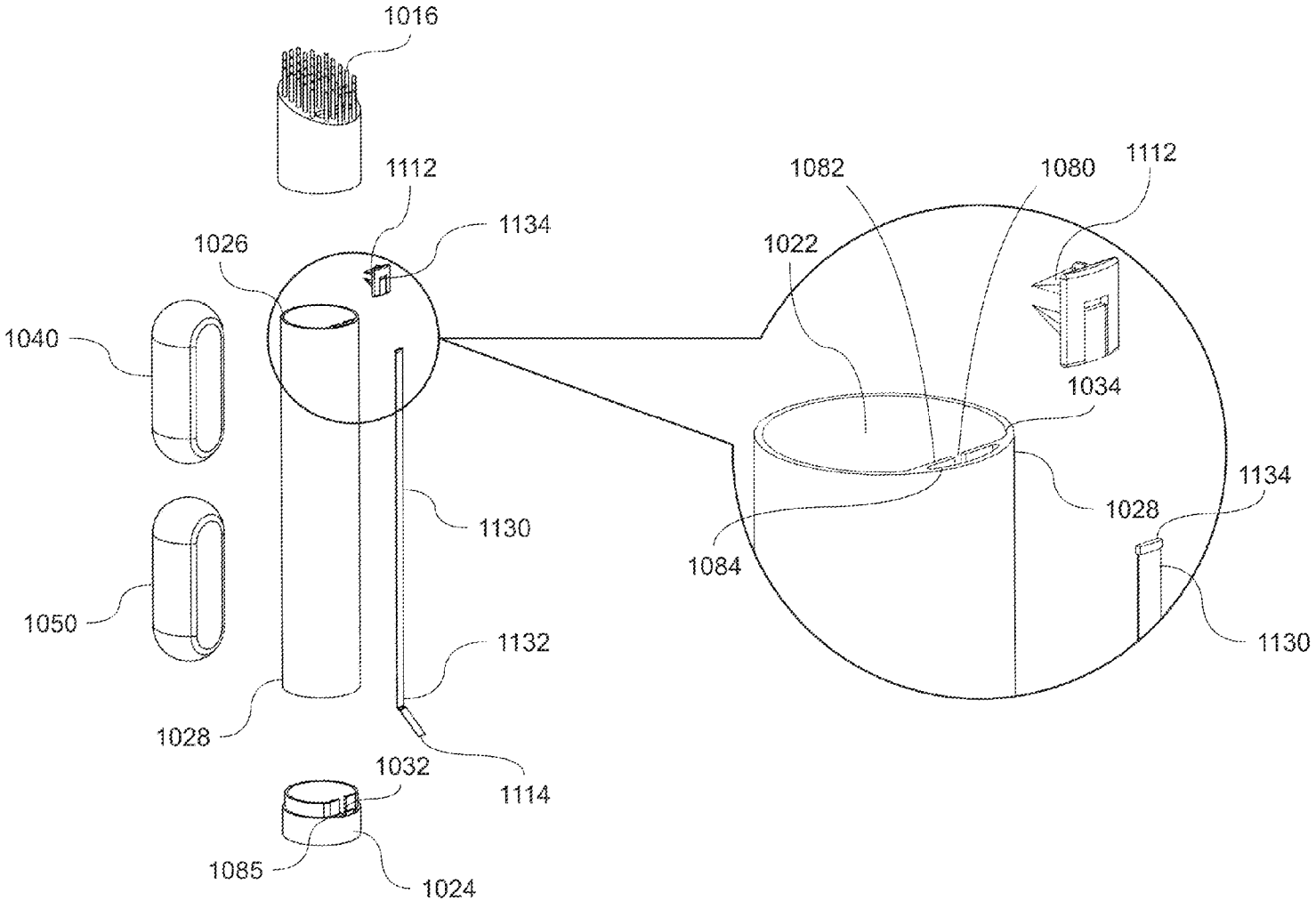
FIG. 12 is a perspective view of an embodiment of the present invention having a pull-member, illustrated with the structural elements thereof disassembled.
FIG. 13 is an enlarged perspective view of an embodiment of the present invention having a pull-member.
Figure 15:
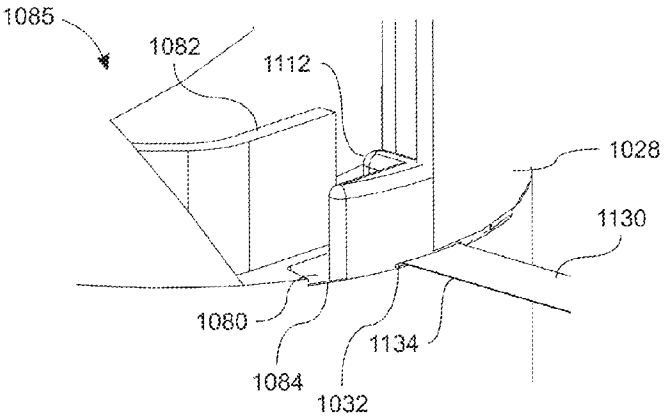
FIGS. 14-16 are enlarged perspective views of an embodiment of the present invention having a pull-member, wherein the cutting edge of the pull-member is detachable.
Figure 14:
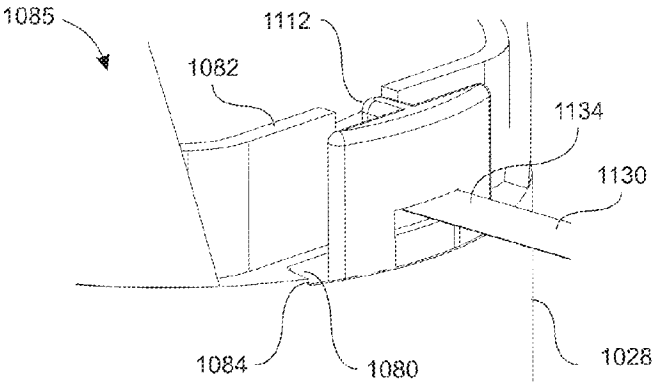

As shown in FIGS. 12-13, an embodiment using a pull-member 1130 can also include at least a first elevation 1082 and second elevation 1084 on an interior surface 1034 of a wall 1028 of the device 1010. The pull-member 1130 is capable of sliding along the interior surface 1034 where the first 1082 and second 1084 elevations meet. As a non-limiting example, a groove 1080 can be formed along an inner surface 1034 of at least one wall 1028 of the housing 1020 to guide the pull-member 1130. In this embodiment, the pull-member 1130 resembles the cursor 1110 embodiment described above. In another embodiment as shown in FIGS. 13-16, the cutting edge 1112 can detach from the pull-member 1130. In this embodiment, the housing 1020 can further comprise a stopper 1085 for the cutting edge 1112 at the end of the groove 1080 in which the cutting edge 1112 stops when the pull-member 1130 passes the stopper 1085 such that the cutting edge 1112 completely detaches from the pull-member 1130. The aperture 1032 in which the pull-member 1130 goes through can act as a squeegee on the pull-member 1130, which can be dry when located inside the groove 1080, and is made to fit the pull-member 1130 minimize any type of spill hazard when mixing. The aperture 1032 can further comprise a seal fitted around the pull-member 1130 to prevent leakage.

Figure 23:
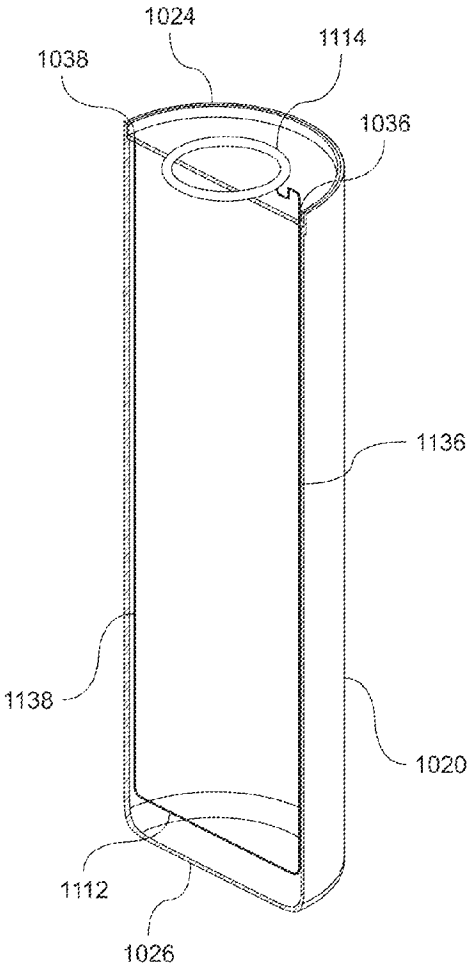
Figure 22:
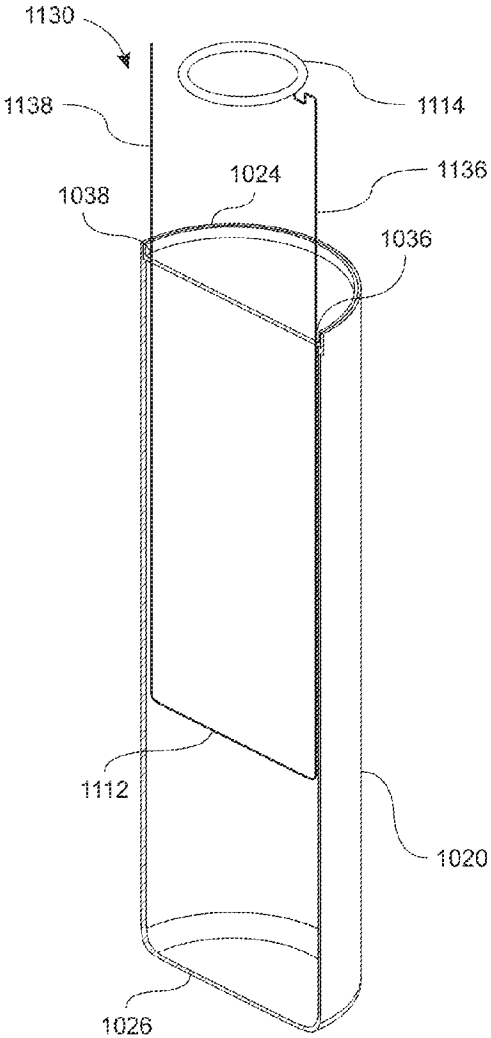

Another embodiment utilizing a pull-member 1130 is shown in FIGS. 22-23. A first end 1024 of the device 1010 comprises a first aperture 1036 and a second aperture 1038. The first 1036 and second aperture 1038 can be on opposing sides of an end of the device. However, the first 1036 and second aperture 1038 need not be on opposing sides. In this embodiment, the pull-member 1130 has a first leg 1136 that extends through the first aperture 1036, and a second leg 1138 that extends through the second aperture 1038. The first leg 1136 and second leg 1138 are connected within the interior portion 1022 of the housing 1020 to form a cutting edge 1112. The first leg 1136 and second leg 1138 need not be straight or parallel and can be connected in any shape, such as a V-shape or a U-shape, as shown in FIGS. 22-23.

The pull-member 1130 further comprises a handle 1114 at least partially outside of said housing 1020 and connected to at least one of the legs for manipulating the pull-member 1130. As illustrated in FIGS. 22-23 a user pulls the handle 1114 of the pull-member 1130 and the cutting edge 1112 of the pull-member 1130 breaks open the receptacle(s) 1040, 1050 as the receptacle(s) 1040, 1050 are compressed by the pull-member 1130 within the housing 1020 to release and mix the hair color chemical(s). This embodiment does not require a separate protruding cutting edge on the pull-member 1130 because the pull-member 1130 itself forms a cutting edge 1112 to break open the receptacle(s) 1040, 1050. If desired, the user can shake the device 1010 to further mix the chemicals. Once the chemicals are mixed, the user can open the device 1010 and apply the mixture to hair using an applicator 1016. The device 1010 can be opened by removing one end of the device 1010. The pull-member 1130 of the aforementioned embodiments can be made from wire, plastic, or another material suitable to carry out the above features of the device 1010.

Figure 31:
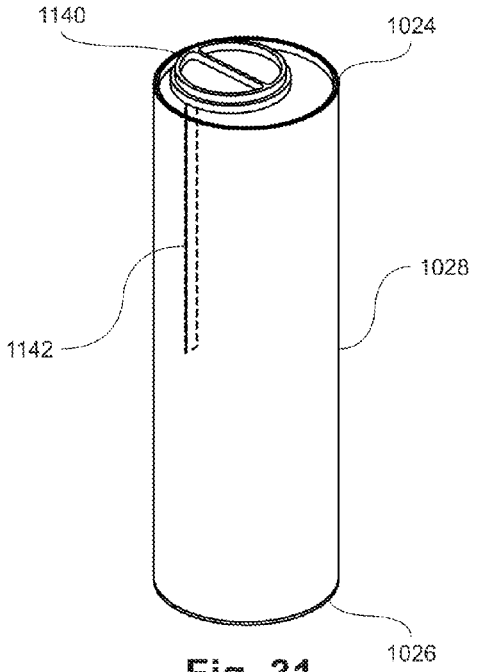
FIG. 31 is a transparent view of an embodiment of the present invention having a rotating member.
Figure 32:
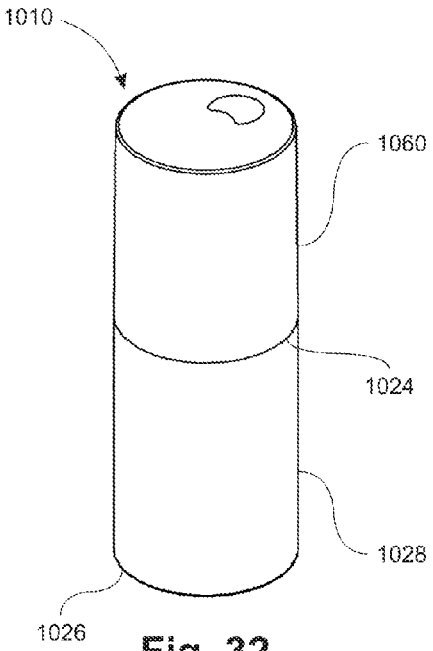
FIG. 32 is a perspective view of an embodiment of the present invention having a cap.
Figure 33:
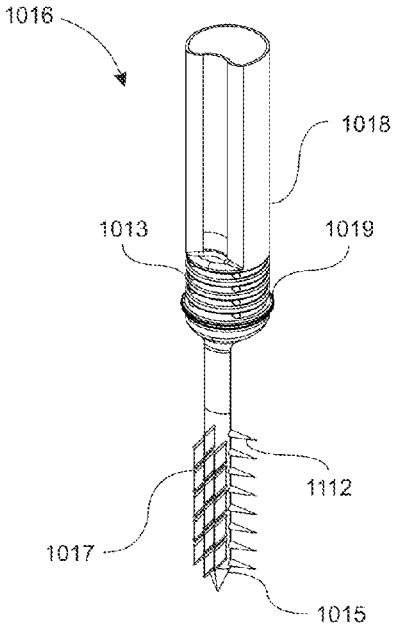
FIG. 33 is a perspective view of an embodiment of an applicator of the present invention.
Figure 34:
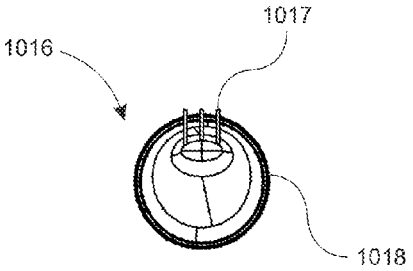
FIG. 34 is a bottom view of an embodiment of an applicator of the present invention.
Figure 37:
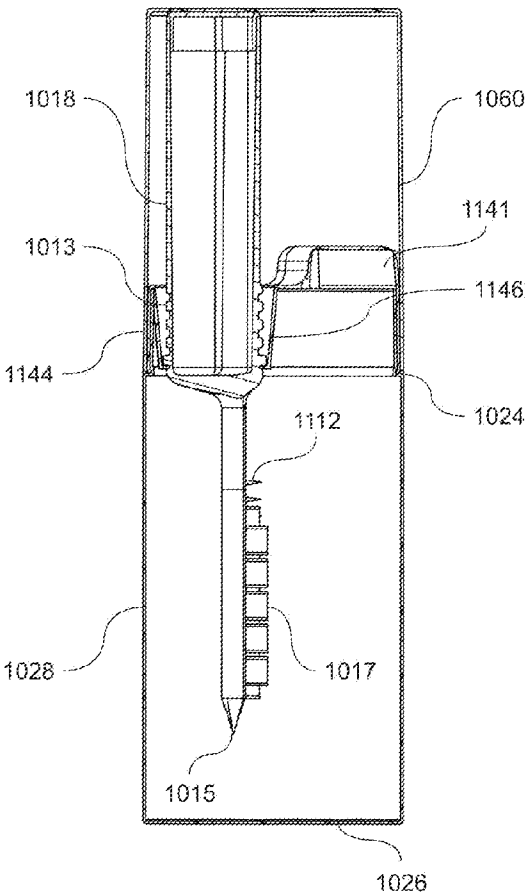
FIG. 37 is a cross-sectional view of an embodiment of the present invention having a rotating member.
Figure 36:
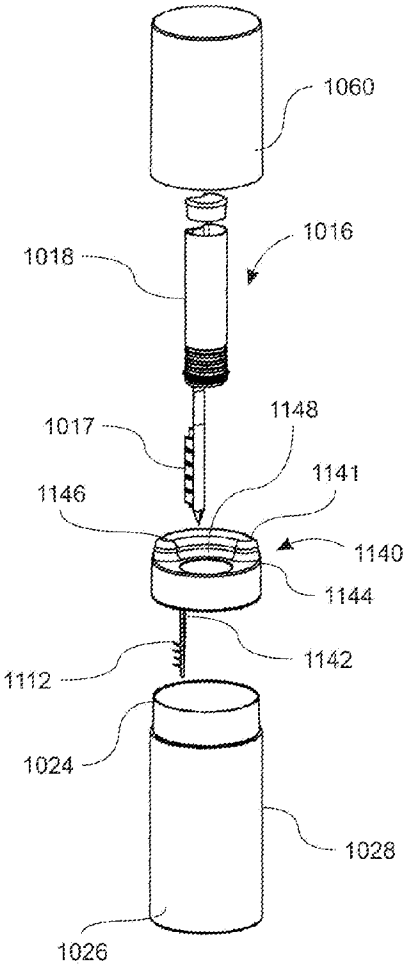
FIG. 36 is a perspective view of an embodiment of the present invention having a rotating member, illustrated with the structural elements thereof disassembled.
Figure 35:
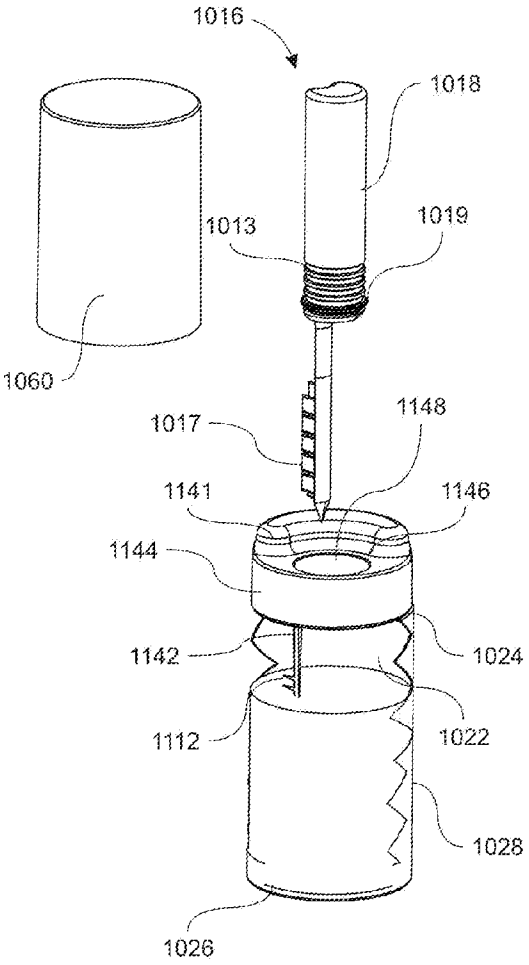
FIG. 35 is a transparent, perspective view of an embodiment of the present invention having a rotating member.

Embodiments of the Present Invention Having a "Rotatable Element" Cutting Member In one embodiment of the device 1010 using a rotatable element 1140, the rotatable element 1140 is rotatably attached with one end of the housing 1020 and further comprises at least one arm 1142 extending therefrom. As shown in FIG. 31, the rotatable element 1140 can be inset within an end of the housing 1020. The at least one arm 1142 is capable of cutting or tearing open the receptacle(s) 1040, 1050 within the housing 1020 when the rotatable element 1140 is rotated, thereby releasing the hair coloring chemical(s) from the receptacle(s) 1040, 1050 so that the chemicals can mix within the housing 1020. The receptacle(s) 1040, 1050 can open due to the shearing force of the arm 1142 against the receptacle(s) 1040, 1050, particularly when the receptacle(s) 1040, 1050 are adhesively attached to a wall 1028 of the device 1010.

In the embodiments shown in FIGS. 35-48, the at least one arm 1142 of the rotatable element 1140 further comprises a cutting edge 112 to puncture or cut open the receptacle(s) 1040, 1050 within the housing 1020. Similar to the other embodiments, the cutting edge 1112 of the arm 1142 can be jagged to rupture the receptacle(s) 1040, 1050 containing the hair coloring chemicals as the cutting edge 1112 comes in contact with the receptacle(s) 1040, 1050.

The rotatable element 1140 can be separately attached with the housing 1020 or be an integral part of the housing 1020. In either embodiment, the rotatable element 1140 and the housing 1020 are configured such that the outer perimeter wall 1144 of the rotatable element 1140 can engage the top portion of the housing 1020 so as to be rotatably attached to the housing 1020. For example, the inner diameter of the outer perimeter wall 1144 of the rotatable element 1140 may be substantially the same as the outer diameter of the top portion of the housing 1020. In such an embodiment, the top portion of the housing 1020 can fit into and frictionally engage the outer perimeter wall 1144 of the rotatable element 1140 so that the housing 1020 is rotatably attached to the rotatable element 1140.

In another embodiment, the outer perimeter wall 1144 of the rotatable element 1140 and one end of the housing 1020 can further comprise corresponding male and female components to engage one another, such as a ridge and corresponding recess that can snap together and still allow rotation of the rotatable element 1140. Alternatively, the rotatable element 1140 may be integrally connected to the housing 1020 such that the rotatable element 1140 is not detachable from the housing 1020 but can rotate freely about the housing 1020.

Figure 39:
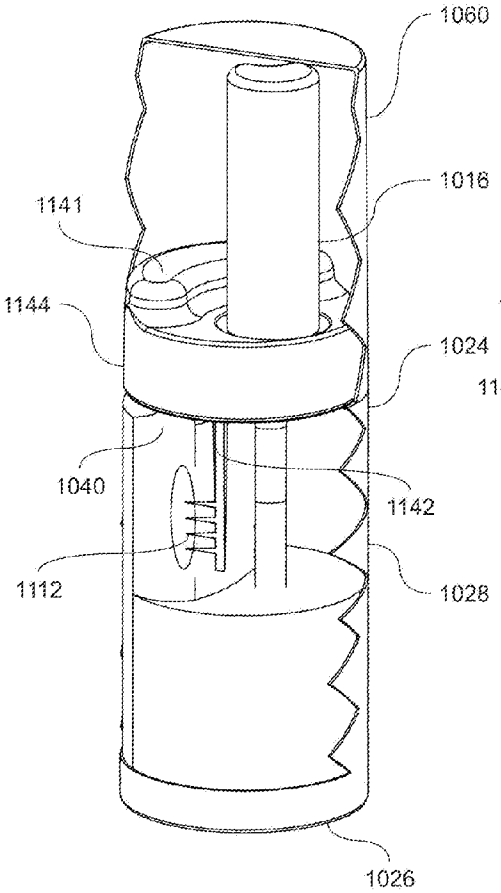
Figure 38:
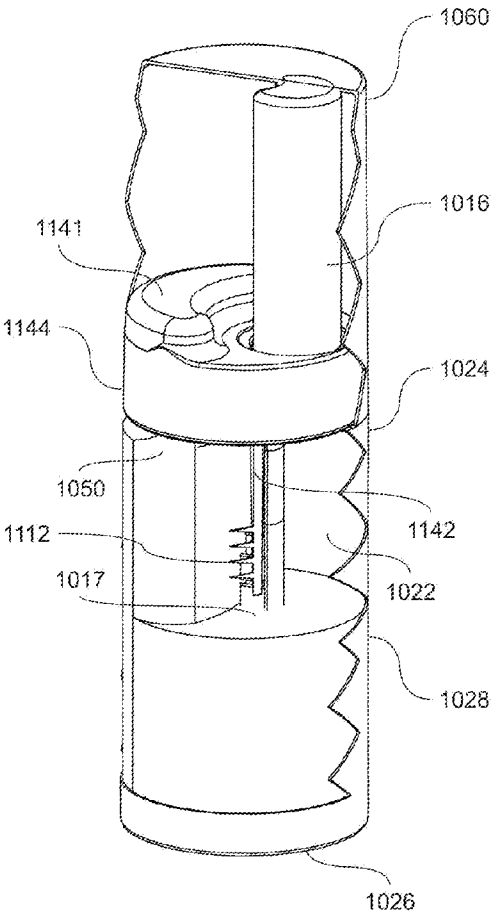
Figure 42:
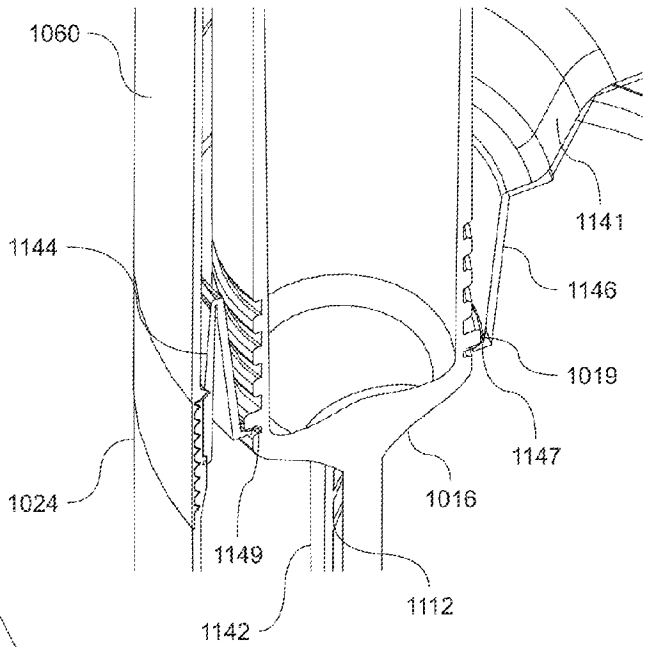
FIGS. 42-43 are enlarged, cross-sectional, perspective views of a rotating member and applicator of the present invention.
Figure 43:
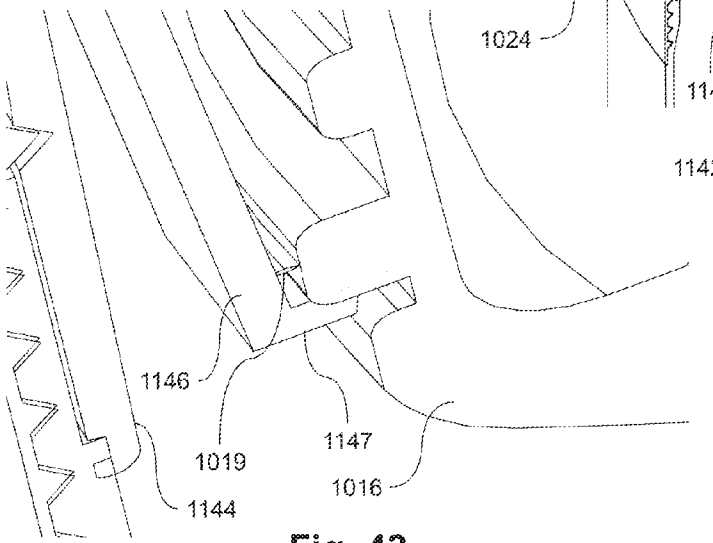
Figure 41:
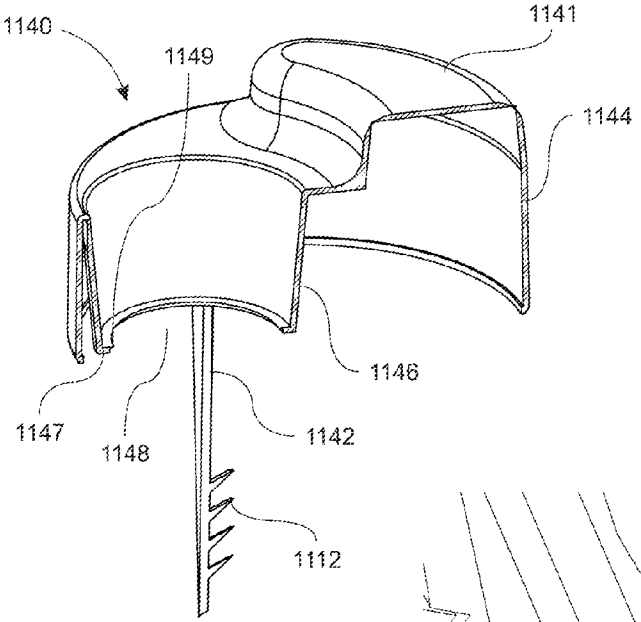
FIG. 41 is a cross-sectional, perspective view of a rotating member of the present invention.
Figure 45:
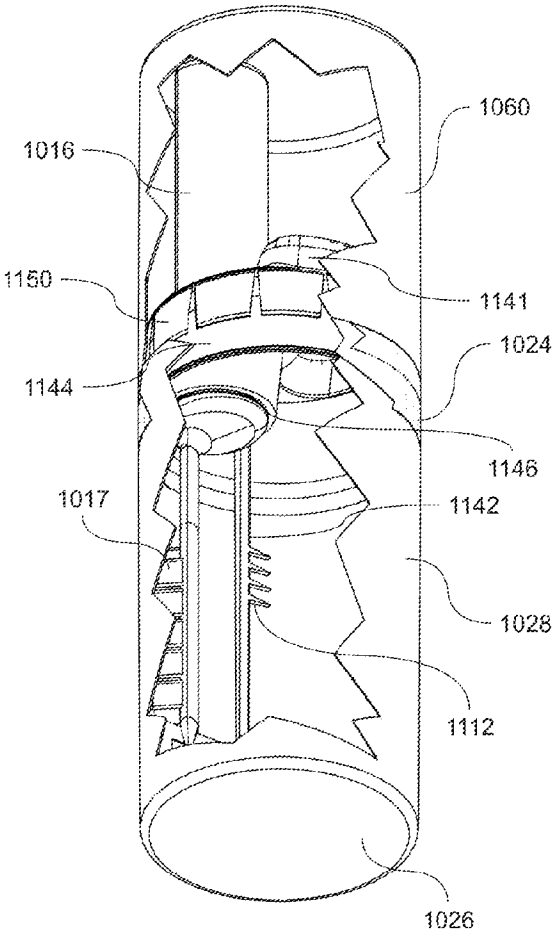
FIG. 45 is a transparent, perspective view of an embodiment of the present invention having a rotating member.
Figure 44:
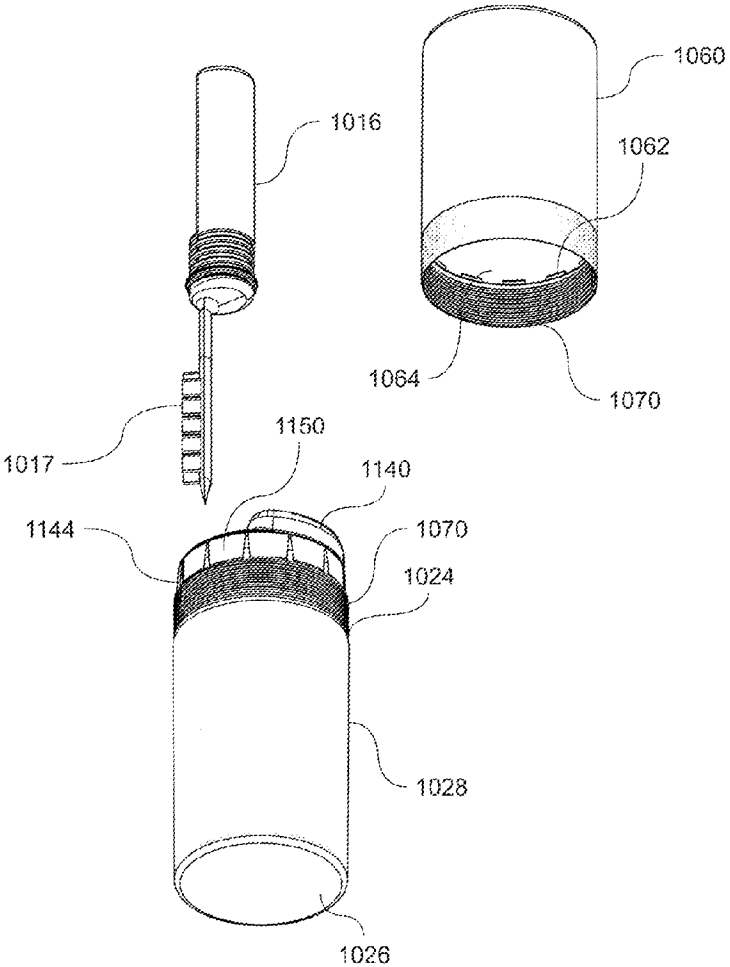
FIG. 44 is a perspective view of an embodiment of the present invention having a rotating member, illustrated with the structural elements thereof disassembled.

In an embodiment shown in FIGS. 38-40, the rotatable element 1140 further comprises an outer perimeter wall 1144 and an inner skirt 1146 formed inwardly from the top surface of the rotatable element 1140. The inner skirt 1146 of the rotatable element 1140 defines an opening 1148 in the top surface of the rotatable element 1140, and is capable of receiving an applicator 1016. The inner skirt 1146 therefore allows the applicator 1016 to sit lower within the device 1010 and reach the liquids at the bottom of the device 1010. As shown in FIG. 41, the inner skirt 1146 can be tapered to facilitate repeated insertion of the applicator 1016 to apply the mixture of hair coloring chemicals.

In such an embodiment, the inner skirt 1146 can further comprise a lip 1147 at the base of the inner skirt 1146 that tightly seals any gap between the inner skirt 1146 and the applicator 1016. When the applicator 1016 is in an inserted position in the rotatable element 1140, the handle 1018 of the applicator 1016 is located in the opening 1148 of the rotatable element 1140, and the brush 1017 of the applicator 1016 is located within the interior portion 1022 of the device 1010. The applicator 1016 can further comprise at least one recess 1013 formed on the handle 1018 that is capable of engaging the lip 1147 of the inner skirt 1146 of the rotatable element 1140.

The lip 1147 of the inner skirt 1146 can also include a thin sheet of material 1149 extending slightly therefrom that is thin and flexible enough to allow the applicator 16 to move in and out through the opening 1148. The thin sheet of material 1149 is formed during the manufacturing process by flashing. Flashing is a term commonly used to describe injection molding mistakes where a thin layer of plastic escapes out of the mold and remains attached to the thicker body. In the present invention, flashing is beneficial and can be done on purpose to act because the resulting extra material acts as a seal. The thin layer of material 1149 provided can deform due to its thin flexible structure when hitting a thicker body. Because the diameter of the flashing ring 1149 is larger than the diameter of the opening 1148 in which the applicator 1016 extends through, the flashing ring 1149 can create a positive pressure seal.

Likewise, the applicator 1016 can include a thin sheet of material 1019 extending slightly past the handle 1018 of the applicator 1016. The thin sheet 1019 extending slightly past the handle 1018 of the applicator 1016 can also be formed from flashing during the manufacturing process. This thin sheet 1019 further facilitates forming a seal between the applicator 1016 and rotatable element 1140. Thus, a double seal can be created between the applicator 1016 and rotatable element 1140 via one flashing ring 1149 formed at the base or on the lip 1147 of the inner skirt 1146 of the rotatable element 1140, and another flashing ring 1019 formed around the handle 1018 of the applicator 1016.

In another embodiment shown in FIGS. 35-48, the rotatable element 1140 has a raised portion 1141 on the top surface of the rotatable element 1140, on the side opposite of the inner skirt 1146. The raised portion 1141 increases the capacity for air volume or hair coloring chemicals held within the device 1010. The raised portion 1141 also allows for gas expansion within the device 1010 when the hair coloring chemicals mix.

Figures 46, 47, 48:
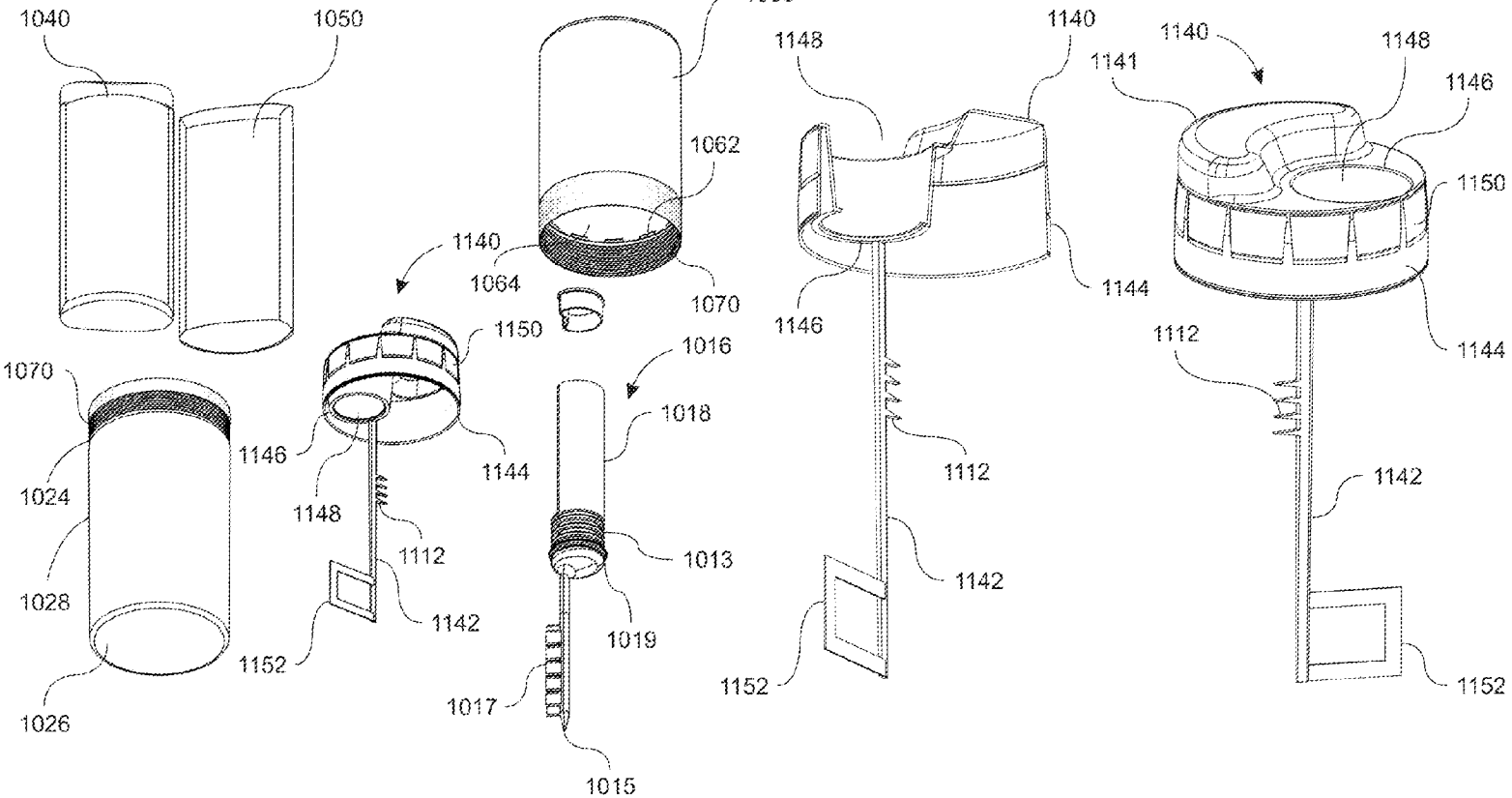
FIG. 46 is a perspective view of an embodiment of the present invention having a rotating member, illustrated with the structural elements thereof disassembled.
FIG. 47 is a cross-sectional, perspective view of a rotating member of the present invention.
FIG. 48 is a perspective view of a rotating member of the present invention.

As shown in FIGS. 47-48, the arm 1142 of the rotatable element 1140 can further comprise an agitator 1152, such as a stirring element or another structure suitable for mixing or blending liquids, to further mix the hair coloring chemicals within the housing 1020. The arm 1142 can be molded as part of the rotatable element 1140 or inserted into a receiving portion of the rotatable element 1140.

As shown in FIGS. 32, 35-40 and 44-46 the device 1010 can include a cap 1060 removably fitted about the rotatable element 1140 and/or the housing 1020. The cap 1060 can be fitted so that it is frictionally engaged to stay in place on the rotatable element 1140 and/or the housing 1020. For example, the inner diameter of the cap 1060 may be substantially the same as the outer diameter of the rotatable element 1140 and/or housing 1020. In such an embodiment, the cap 1060 can fit onto and frictionally engage the outer perimeter wall 1144 of the rotatable element 1140 or the housing 1020.

In example embodiments illustrated in FIGS. 44-48, the cap 1060 can comprise female threaded portion 1070, and the housing 1020 can comprise male threaded portion 1070, or vice versa. The female threads 1070 can twist on and off the male threads 1070, or vice versa, such that said cap 1060 is removably attachable to the housing 1020. Advantages of embodiments of the device 1010 incorporating a threading includes providing a fool-proof manner of mixing the hair coloring chemicals as it automatically mixes the chemicals evenly and smoothly when the cap 1060 is twisted off by the user. In accordance with this embodiment, a user need not shake the device 1010. This embodiment also requires less air within the device 1010 because the air is not needed to facilitate the mixing of the liquids when a user shakes the device 1010. The embodiments incorporating projections within the cap 1060 and recessed portions 1150 on the twistable element likewise have similar advantages and ensure easy, even, and smooth mixing.

FIGS. 44-48 illustrate embodiments including a cap, where the rotatable element 1140 can further comprise at least one recess portion 1150 and the cap 1060 comprises at least one projecting element 1062 protruding from an inside surface 1064 of the cap 1060. The projecting element(s) 1062 of the cap 1060 are capable of engaging the recessed portion(s) 1150 of the rotatable element 1140 so that the rotatable element 1140 is rotated when the cap 1060 is twisted off the rotatable element 1140 and/or housing 1020. As the rotatable element 1140 is turned, the cutting edge 1112 of the arm 1142 of the rotatable member can puncture at least one receptacle 40 within the interior portion 1022 of the device 1010. Upon puncture, the receptacle(s) 1040, 1050 attached to a wall 1028 will retract to a peripheral edge of a wall 1028 of the device 1010 so that the hair coloring chemicals, such as a developer and custom color, are mixed together. To facilitate mixing the developer and the custom color, the user may shake the device 1010.

Embodiments of the Present Invention Having a "Push Element" Cutting Member

Figure 65:
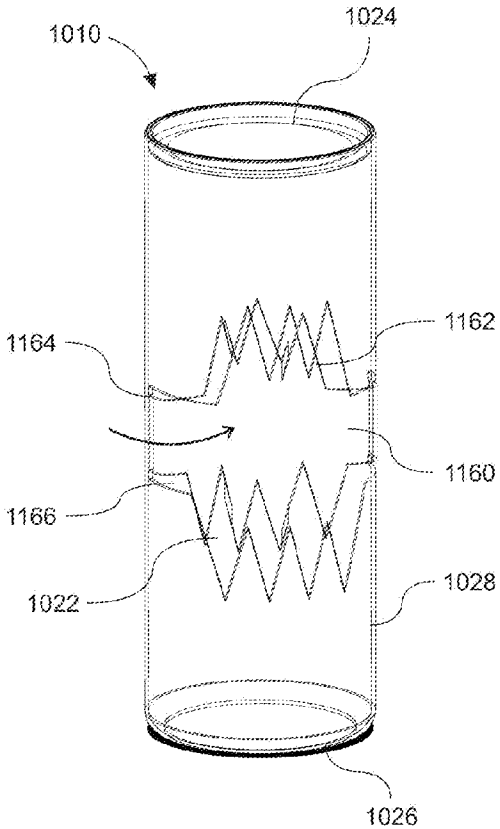
FIGS. 64-65 illustrate a method of using an embodiment of the present invention having a wall further comprising a cut-out portion, showing transparent, perspective views of the device as the cut-out portion is depressed, and illustrated without a sheath.
Figure 64:
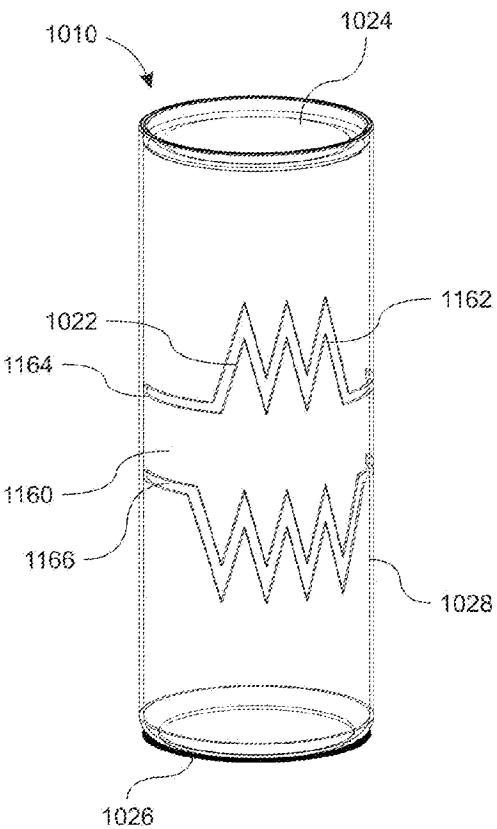
Figure 63:
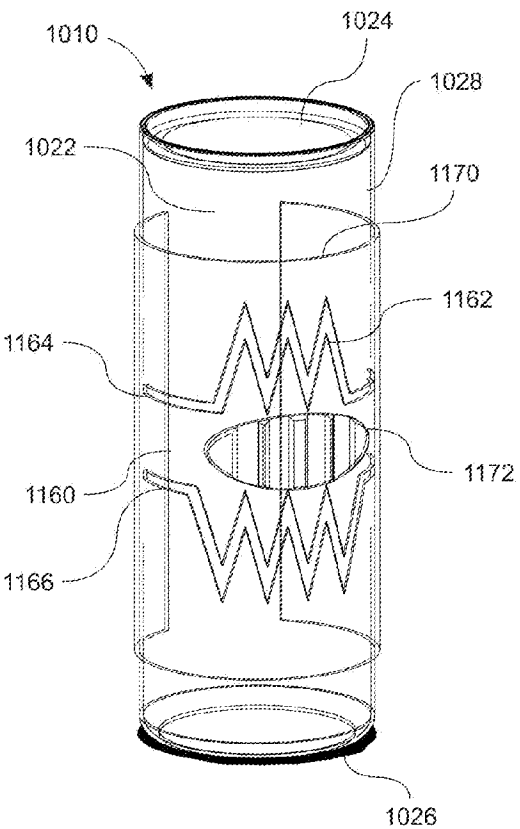
FIG. 63 is a transparent, perspective view of an embodiment of the present invention having a sheath and a wall further comprising a cut-out portion.
Figure 67:
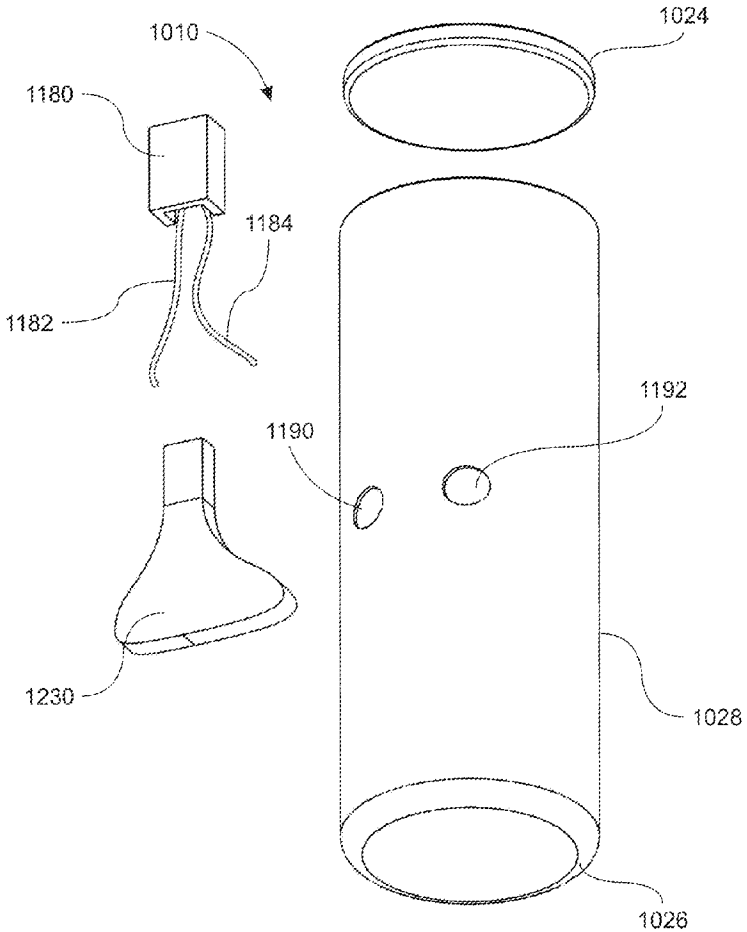
FIG. 67 is a perspective view of an embodiment of the present invention having a push member and a shield, illustrated with the structural elements thereof disassembled.

As illustrated in FIGS. 63-65, the cutting member 1100 of the device 1010 can comprise a cut-out portion 1160 of a wall 1028 of the device 1010. The cut-out portion 1160 is not completely detached from the wall 1028, but can comprise a first slit 1164 and a second slit 1166 through the wall 1028 which can be depressed. To puncture the receptacle(s) 1040, 1050 within the device 1010, the user depresses the cut-out portion 1160 which will force the receptacle(s) 1040, 1050 within the housing 1020 to break open.

These embodiments of the device 1010 including a cut-out portion 1160 further comprise a flexible sheath 1170 sealably covering the cut-out portion 1160. The flexible sheath 1170 can be made of an elastomeric material and seals the cut-out portion 1160 to prevent liquids from escaping through the cut-out portion 1160 of the device 1010. The flexible sheath 1170 can further comprise an indicator 1172 to show the user where to push on the housing 1020 to depress the cut-out portion 1160 that is behind the flexible sheath 1170.

Further, the cut-out portion 1160 comprises a cutting edge 1112. As shown in FIG. 65, the cutting edge 1112 can formed by either the first 1164 or second slit 1166 through the wall 1028, wherein each slit can be jagged or sharp. A user can depress the cut-out portion 1160 in the direction of the arrow shown in FIG. 76, such that the cutting edge 1112 can cut open the at least one receptacle 1040 within the housing 1020 of the device 1010 to thereby release and mix the hair coloring chemicals therein.

In another embodiment, the cutting edge 1112 can comprise a separate sharp member 1168, such as a spike, protruding from the inner surface of the cut-out portion 1160 and into the interior portion 1022 of the housing 1020. The sharp protruding member can cut open the at least one receptacle 1040 within the housing 1020 to thereby mix the hair coloring chemicals.

In another embodiment illustrated in FIGS. 66-69, the cutting member 1100 of the device 1010 comprises a push member 1180. The push member 1180 includes at least one projecting element 1182 which extends through at least one aperture 1190 in a wall 1028 of the housing 1020. In one embodiment, the push member 1180 includes a first projecting element 1182 and a second projecting element 1184 which are received by a first aperture 1190 and a second aperture 1192 in a wall 1028 of the device 1010 when a user pushes the push member 1180.

Figure 66:
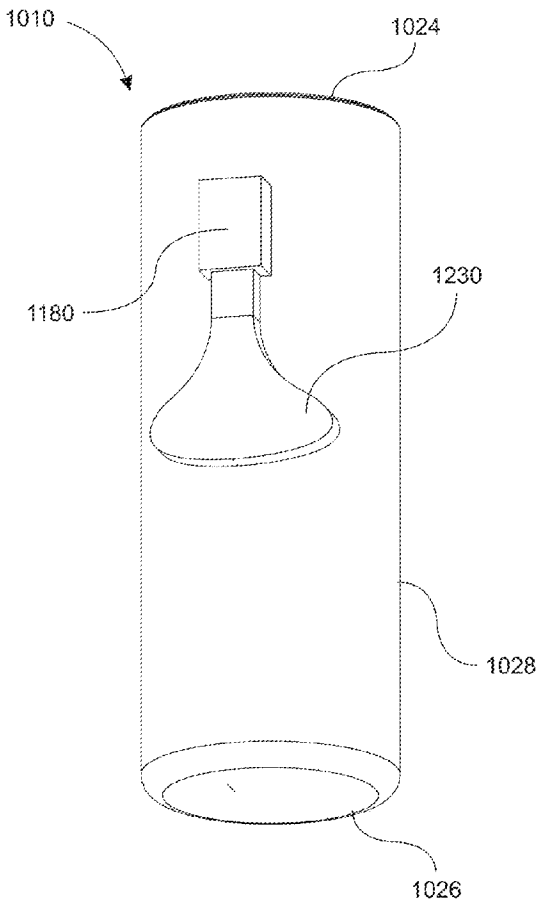
FIG. 66 is a perspective view of an embodiment of the present invention having a push member and a shield.
Figure 68:
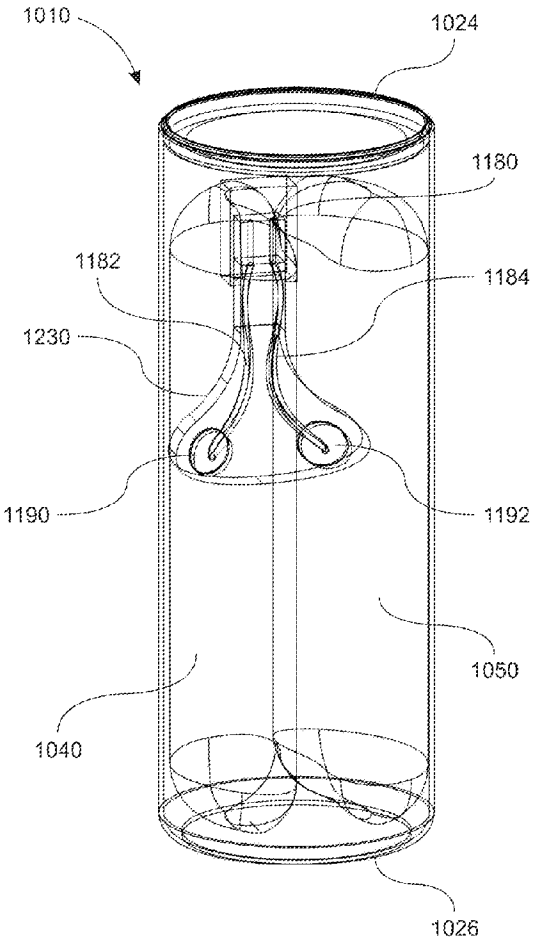
FIG. 68 is a transparent, perspective view of an embodiment of the present invention having a push member and a shield.

The device also comprises a shield 1230 that is capable of covering the at least one aperture 1190 and can guide the push member 1180. The push member 1180 and shield 1230 can engage each other in a non-limiting manner. For example, the push member 1180 can fit over and slide along the shield 1230, as shown in FIGS. 66 and 68-69. The shield 1230 can also comprise a feature 1232 to guide the projecting element 1182 through the at least one aperture 1190. For example, as shown in FIG. 69, the shield 1230 can include a channel 1232 or a first elevation and a second elevation to lead the projecting element 1182 to the aperture 1190. The shield 1230 also sealably covers the aperture(s) so that fluids do not escape from within the interior portion 1022 of the housing 1020 through the at least one aperture 1190.

When a user pushes the push member 1180, e.g., in the direction indicated by an arrow shown in FIG. 80, the at least one projecting element 1182 punctures the receptacle(s) 1040, 1050 within the device thereby release at least one hair coloring chemical from at least one receptacle 1040 to mix with another hair coloring chemical within said housing 1020 or another receptacle 1050. The projecting element(s) of the aforementioned embodiments can be made from wire, plastic, or another material suitable to carry out the above features of the device 1010.

Methods of Using the Present Invention

A method of mixing and applying hair coloring chemicals to a person's hair comprises (1) providing any embodiment of the device 1010 describe above; (2) moving the cutting member 1100 of the device 1010 to cut the receptacle(s) 1040, 1050 within the housing 1020 and thereby mix the hair coloring chemicals; and (3) applying the mixture of the hair coloring chemicals to hair. If desired, the user can shake the device 1010 after moving the cutting member 1100 to further mix the hair coloring chemicals. The mixture can be applied to hair using an applicator 1016 having a brush 1017 and handle 1018. The user can repeatedly dip the applicator 1016 into the interior portion 1022 of the device 1010 to remove the hair coloring mixture and readily apply the mixture to hair.

In the embodiments disclosing a cursor 1110 cutting member 1100, the user slides the cursor 1110 along a wall 1028 of the housing 1020 to slice open the receptacle(s) 1040, 1050 within the housing 1020. In the embodiments that disclose a pull-member 1130 cutting member 1100, the user pulls the pull-member 1130 through an aperture 1032 in the housing 1020 to cut open the receptacle(s) 1040, 1050 within the housing 1020 with shear force or a cutting edge 1112. In the embodiments of the device 1010 disclosing a rotatable element 1140, the user rotates the rotatable element 1140 or a cap 1060 covering the rotatable element 1040 to cut open the receptacle(s) 1040, 1050 within the housing 1020. In the embodiments of the device 1010 having a cut-out portion 1160 or push-member, the user pushes the cut-out portion 1160 or push member 1180 to cut open the receptacle(s) 1040, 1050 within the housing.

A method of using the device 1010 having a rotatable element is shown in FIGS. 38-40. The rotatable element 1140 is turned to puncture the receptacle(s) 1040, 1050 within the housing 1020. A hole tears in the receptacle(s) 1040, 1050 upon contact with the cutting edge 1112 of the arm 1142 of the rotatable element 1140. The material of the receptacle reverts to a small deflated form, which can be maintained against a wall 1028 of the housing 1020 if the receptacle is attached to a wall 1028 of the housing 1020. As shown in FIG. 40, the volume of liquid in the container rises as the hair coloring chemical within the receptacle is free to mix with the liquid in the housing 1020. If desired, the user can shake the device 1010 prior to removing the cap. If desired, the user can shake the device 1010 prior to removing the cap. Once the cap 1060 is removed, the applicator 1016 may be used to apply the hair coloring mixture.

Alternatively, the user can rotate the cap 1060 of the device 1010, which engages the rotatable element 1140 and thereby cut open the receptacle(s) 1040, 1050 within the housing 1020. In this method, the hair coloring chemicals are mixed as the cap 1060 is twisted off the housing 1020 of the device 1010. Because the projecting elements 1062 of the cap 1060 engage the recessed portions 1150 of the rotatable element 1140, the cap 1060 thereby rotates the cutting edge 1112 and brush 1017 within the rotatable element 1140 to mix the hair coloring chemicals. If desired, the user can shake the device 1010 prior to removing the cap 1060 to further mix the hair coloring chemicals.

This method of using the device 1010 is advantageous in that it requires one-step removal of the cap 1060 to mix the hair coloring chemicals separately contained within receptacle(s) 1040, 1050 and/or housing 1020 of the device 1010. The device 1010 can also provide an advantage over the prior art in that it can adequately mix the hair coloring chemicals without shaking the device 1010 because both the cutting edge 1112 of the rotatable element 1140 and the applicator 1016 (which rotates with the rotatable element 1140 when the cap 1060 is removed) work as agitators. In addition, the device 1010 can include an additional agitator 1152 attached with the rotatable element 1140 of the device 1010.

As the user unscrews the cap 1060 off the device 1010, the agitator 1152 mixes the liquids within it (once the blisters are opened). The amount of threading 1070 can affect the amount of mixing, as the threaded portion 1070 increases, so does the rotation of the rotatable element 1140 and therefore the mixing. As a non-limiting example, the device 1010 can be manufactured such that the cap 1060 releases after eight full rotations. Upon releasing the cap 1060 the mixture is already mixed and shaking is not required. The device 1010 is ready to be used depending on the amount time needed for the hair coloring chemicals to chemically interact.

As part of the method of embodiments using a cap, once the user removes the cap, the applicator 1016 that was previously held in place by the cap 1060 can be removed and repeatedly dipped within the housing 1020 to collect the mixture of hair coloring chemicals and apply the mixture to hair.

The above construction and properties of the device 1010 allow a user to easily store hair coloring chemicals and carry them in the device 1010 without a spillage of the chemicals during travel so that the user mixes and applies the hair coloring chemicals to his/her hair at any time and at any place.

While the said detailed description elaborates workable embodiments of the present invention, the said embodiments shall not be construed as a limitation on the patented scope and claims of the present invention and, furthermore, all equivalent adaptations and modifications based on the technological spirit of the present invention shall remain protected within the scope and claims of the invention herein.

What is claimed is:

1. A device for mixing and applying hair coloring chemicals to a person's hair, the device comprising:

a housing comprising an interior portion, a first end, a second end, and at least one wall enclosing said interior portion;

at least two receptacles located within said interior portion, wherein at least one of said at least two receptacles contains a first hair coloring chemical and at least one of said at least two receptacles contains a second hair coloring chemical;

a cutting member movably secured to said housing;

whereby said cutting member is capable of cutting open said at least two receptacles when moved thereby releasing said at least one second hair coloring chemical from said at least one receptacle to mix with said first hair coloring chemical within said housing;

wherein said first end of said housing includes a first aperture and a second aperture;

said cutting member comprises a pull-member having a first leg, a second leg where said first leg extends through said first aperture, and said second leg extends through said second aperture, said first and second legs connected within said interior portion to form a cutting edge;

said pull member having a handle at least partially outside of said housing and connected to at least one of said first and second legs for manipulating said pull-member;

whereby said pull-member is capable of cutting open said at least two receptacles when said pull-member is pulled thereby releasing said first hair coloring chemical and said second hair coloring chemical to mix within said housing.

2. A device for mixing and applying hair coloring chemicals to a person's hair, the device comprising:

a housing containing a first hair coloring chemical, wherein said housing comprises an interior portion, a first end, a second end, and at least one wall enclosing said interior portion;

at least one receptacle containing at least one second hair coloring chemical, wherein said at least one receptacle is located within said interior portion of said housing;

a cutting member movably secured to said housing;

whereby said cutting member is capable of cutting open said at least one receptacle when moved and thereby releasing said at least one second hair coloring chemical from said at least one receptacle to mix with said first hair coloring chemical within said housing;

wherein said cutting member comprises a cut-out portion on said at least one wall;

said cut-out portion comprises a cutting edge; and said device further comprising a flexible sheath capable of sealing at least said cut-out portion, whereby said cutting edge is capable of cutting open said at least one receptacle when said cut-out portion is depressed thereby releasing said at least one second hair coloring chemical from said at least one receptacle to mix with said first hair coloring chemical within said housing.

3. A device for mixing and applying hair coloring chemicals to a person's hair, the device comprising:

a housing comprising an interior portion, a first end, a second end, and at least one wall enclosing said interior portion;

at least two receptacles located within said interior portion, wherein at least one of said at least two receptacles contains a first hair coloring chemical and at least one of said at least two receptacles contains a second hair coloring chemical;

a cutting member movably secured to said housing;

whereby said cutting member is capable of cutting open said at least two receptacles when moved thereby releasing said at least one second hair coloring chemical from said at least one receptacle to mix with said first hair coloring chemical within said housing;

wherein said cutting member comprises a cut-out portion on said at least one wall;

said cut-out portion comprises a cutting edge; and said device further comprising a flexible sheath capable of sealing at least said cut-out portion, whereby said cutting edge is capable of cutting open said at least two receptacles when said cut-out portion is depressed thereby releasing said first hair coloring chemical and said second hair coloring chemical to mix within said housing.

4. A device for mixing and applying hair coloring chemicals to a person's hair, the device comprising:

a housing containing a first hair coloring chemical, wherein said housing comprises an interior portion, a first end, a second end, and at least one wall enclosing said interior portion;

at least one receptacle containing at least one second hair coloring chemical, wherein said at least one receptacle is located within said interior portion of said housing;

a cutting member movably secured to said housing;

whereby said cutting member is capable of cutting open said at least one receptacle when moved and thereby releasing said at least one second hair coloring chemical from said at least one receptacle to mix with said first hair coloring chemical within said housing;

wherein said cutting member further comprises a push member having at least one projecting element;

said at least one wall includes at least one aperture capable of receiving said at least one projecting element;

said device further comprising a shield capable of sealing said at least one aperture and guiding said at least one projecting element through said at least one aperture, whereby said at least one projecting element punctures said at least one receptacle when said push member is pushed thereby releasing said at least one second hair coloring chemical from said at least one receptacle to mix with said first hair coloring chemical within said housing.

5. A device for mixing and applying hair coloring chemicals to a person's hair, the device comprising:

a housing comprising an interior portion, a first end, a second end, and at least one wall enclosing said interior portion;

at least two receptacles located within said interior portion, wherein at least one of said at least two receptacles contains a first hair coloring chemical and at least one of said at least two receptacles contains a second hair coloring chemical;

a cutting member movably secured to said housing;

whereby said cutting member is capable of cutting open said at least two receptacles when moved thereby releasing said at least one second hair coloring chemical from said at least one receptacle to mix with said first hair coloring chemical within said housing;

wherein said cutting member further comprises a push member having a first projecting element and a second projecting element;

said at least one wall includes a first aperture capable of receiving said first projecting element and a second aperture capable of receiving said second projecting element;

said device further comprising a shield capable of sealing said first aperture and said second aperture and guiding said first projecting element through said first aperture and said second projecting element through said second aperture, whereby said first projecting element and said second projecting element puncture said at least two receptacles when said push-member is pushed thereby releasing said first hair coloring chemical and said second hair coloring chemical to mix within said housing.

* * * * *

UNITED STATES PATENT AND TRADEMARK OFFICE

CERTIFICATE OF CORRECTION

PATENT NO. : 8,820,333 B2
APPLICATION NO. : 13/816478
DATED : September 2, 2014
INVENTOR(S) : Cristophe Schatteman, Joshua B. Sybrowsky and Jean Rooryck It is certified that error appears in the above-identified patent and that said Letters Patent is hereby corrected as shown below:

Title page, item (76), the inventors names are Cristophe Schatteman, Joshua B. Sybrowsky, and Jean Rooryck. The correct spelling of the inventor Jean Rooryck's last name is Rooryck.

Signed and Sealed this
Sixteenth Day of December, 2014

Michelle K. Lee

Michelle K. Lee
*Deputy Director of the United States Patent and Trademark Office*